US010857551B1

(12) United States Patent
Duffin et al.

(10) Patent No.: US 10,857,551 B1
(45) Date of Patent: Dec. 8, 2020

(54) SPRINKLER WITH RADIALLY LIMITED NUTATING SPOOL

(71) Applicant: XCAD VALVE AND IRRIGATION, INC., Paul, ID (US)

(72) Inventors: Don Duffin, Paul, ID (US); Roger Duffin, Paul, ID (US); Casey Nutt, Paul, ID (US)

( * ) Notice: Subject to any disclaimer, the term of this patent is extended or adjusted under 35 U.S.C. 154(b) by 0 days.

(21) Appl. No.: 16/813,598

(22) Filed: Mar. 9, 2020

(51) Int. Cl.
*B05B 3/00* (2006.01)
*B05B 3/04* (2006.01)

(52) U.S. Cl.
CPC ..... *B05B 3/008* (2013.01); *B05B 3/003* (2013.01); *B05B 3/007* (2013.01); *B05B 3/0486* (2013.01)

(58) Field of Classification Search
CPC ..... B05B 3/008; B05B 3/003; B05B 3/007; B05B 3/0486
USPC ..... 239/222.11, 222.15, 222.17, 222.21
See application file for complete search history.

(56) References Cited

U.S. PATENT DOCUMENTS 2,848,276 A * 8/1958 Clearman ..... B05B 3/0486 239/382
4,221,338 A * 9/1980 Shames ..... B05B 1/1654 239/427
5,381,960 A * 1/1995 Sullivan ..... B05B 3/008 239/222.17
6,186,414 B1 * 2/2001 Clearman ..... B05B 3/0486 239/214
6,199,771 B1 * 3/2001 Clearman ..... B05B 3/0445 239/222.11
6,254,275 B1 * 7/2001 Slaughter, Jr. ..... E21B 10/25 175/369
6,814,078 B2 * 11/2004 Crook ..... A61B 17/0293 128/849
7,287,710 B1 * 10/2007 Nelson ..... B05B 3/006 239/222.17
10,239,066 B2 * 3/2019 Sesser ..... B05B 1/3026
2003/0192553 A1 * 10/2003 Rambo ..... A61B 17/0293 128/850
2006/0091232 A1 * 5/2006 Grant ..... B05B 3/008 239/19
2006/0249594 A1 * 11/2006 Pinch ..... B05B 3/0486 239/222.21
2008/0017732 A1 * 1/2008 Perkins ..... B05B 3/008 239/222.17
2010/0038450 A1 * 2/2010 Sesser ..... B05B 3/008 239/222.17
2010/0252654 A1 * 10/2010 Sesser ..... B05B 3/008 239/222.17
2011/0031325 A1 * 2/2011 Perkins ..... B05B 3/0486 239/1

(Continued)

*Primary Examiner* — Joseph A Greenlund
(74) *Attorney, Agent, or Firm* — Scott D. Swanson; Shaver & Swanson, LLP

(57) ABSTRACT

A sprinkler head having a spool assembly for nutating within the sprinkler head. The spool assembly has a spool attached by one or more arms to a distribution disc. The sprinkler head has a nozzle configured to spray a fluid stream through a central bore of the spool onto the distribution disc, causing nutation of the spool assembly within the sprinkler head. The spool assembly is configured with two friction bands that are each configured to radially roll in or on a respective race within the sprinkler body. The friction bands can be integrally formed with the spool assembly or positioned on the spool surface.

20 Claims, 28 Drawing Sheets

(56) References Cited

U.S. PATENT DOCUMENTS

| | | | | |
|---|---|---|---|---|
| 2013/0327846 | A1* | 12/2013 | Sesser | B05B 3/008 239/222.21 |
| 2014/0312143 | A1* | 10/2014 | Duffin | B05B 3/0486 239/233 |
| 2017/0120265 | A1* | 5/2017 | Duffin | B05B 3/0477 |
| 2018/0311684 | A1* | 11/2018 | Lawyer | B05B 3/008 |
| 2019/0210046 | A1* | 7/2019 | Gil Bermudez | B05B 3/021 |
| 2019/0336991 | A1* | 11/2019 | Duffin | B05B 3/008 |
| 2020/0047195 | A1* | 2/2020 | Healy | B05B 3/008 |

* cited by examiner

SPRINKLER WITH RADIALLY LIMITED NUTATING SPOOL

TECHNICAL FIELD

The herein disclosed and claimed inventive concepts generally relate to a sprinkler head, and more particularly to a nutating sprinkler head for randomizing fluid distribution.

BACKGROUND

Irrigation systems such as center pivot systems have a structure from which down tubes are suspended, with sprinkler heads attached to the down tubes. The sprinkler heads may also be mounted on top of the rotating structures of the center pivot systems, or on upward turned ends of the down tubes. Such sprinkler heads can operate in any orientation, because the force of the fluid stream is greater than the force of gravity on the lightweight sprinkler parts. However, for convenience the sprinkler head and its parts are described as being in the orientation as shown in the figures, with "upper", "lower", "top", and "bottom" surfaces applied to the sprinkler parts in the orientation shown in the figures.

These sprinkler heads take a number of different forms and all try to create a uniform and random spread of fluid droplets, or a size which does not result in excessive evaporation. One common type of sprinkler head utilizes a distribution pad connected to a floating cage or spool and is configured to nutate in order to randomly distribute fluid. Clearman educates in U.S. Pat. No. 2,848,276 that a "wobble plate surrounds the neck and is free to move up and down between the upper annular surface formed by the top end of [the] stand and the lower annular surface" and that "the annular surfaces [upper] and [lower] limit movement of [the] wobble plate." Most nutating sprinkler heads utilizing a nutating cage incorporate this same "wobble plate" loading vertically on upper and lower annular surfaces as seen in U.S. Pat. Nos. 3,312,400; 4,773,594; 5,381,960; 5,950,927; 6,176,440; 7,070,122; 7,287,710; and 7,562,833; or inversely, use upper and lower annular surfaces on a spool loading vertically on a plate or disc as seen in U.S. Pat. Nos. 7,287,710; 7,562,833; 7,942,345; and 8,028,932.

Due to the geometry of these annular surfaces being designed to be limited vertically, they must be relatively close together when compared to the diameter of the annular surfaces. This causes the center of rotation of the nutating cage assembly to be near one end of the cage assembly and not near the center of mass of the cage assembly. This can result in excessive vibration in the sprinkler head and can damage the irrigation equipment to which the sprinklers are attached. Thus many ways of mounting this type of sprinkler head have been developed to isolate this vibration, as seen is U.S. Pat. Nos. 4,795,100; 4,949,905; and 5,333,796. Alternatively, sprinklers have been developed with a counterbalance to minimize vibration. However, existing counterbalancing mechanisms typically either have large, exposed moving bodies as seen in U.S. Pat. No. 7,070,122, or require additional enclosures to protect the moving counterbalance as seen in U.S. Patent Pub. No. 2019/0054480.

Additionally, many mechanisms have been developed to cause an initial tilt of the cage assembly on these types of sprinklers with vertically-limited annular surfaces to prevent stalling on startup. One mechanism is to engage the tilting mechanism while running as seen in U.S. Pat. No. 7,770,821, however this can limit the life of the sprinkler because the tilting mechanism is constantly contacted and worn during operation. Another mechanism is to utilize a feature that initially tilts the cage or spool assembly when the sprinkler head is off, and is not contacted during full nutation as seen in U.S. Pat. Nos. 5,950,927; 6,176,440; 7,942,345; and 8,028,932. However, these mechanisms are limited either in the amount of initial tilt of the cage or spool assembly, or in diminishing clearance between a static tilting mechanism and the moving parts of a fully nutating cage or spool as the annular surfaces begin to wear. This limitation is due to the annular surface resting on one of the limiting faces in addition to the tilting mechanism in the starting tilted position, and can only tilt a very limited amount before it contacts the other limiting annular surface. This limitation is believed by the inventors to be inherent in a sprinkler head that utilizes vertically limited annular surfaces.

What is needed is a sprinkler head with a nutating cage assembly having radially limited motion in which the geometry of the motion more naturally aligns the cage assembly's center of mass and center of motion so as to better minimize vibration, and also facilitates improved separation between the initial tilting mechanism and the cage or spool assembly after initiation of nutation.

SUMMARY OF THE DISCLOSURE

Figure 1:
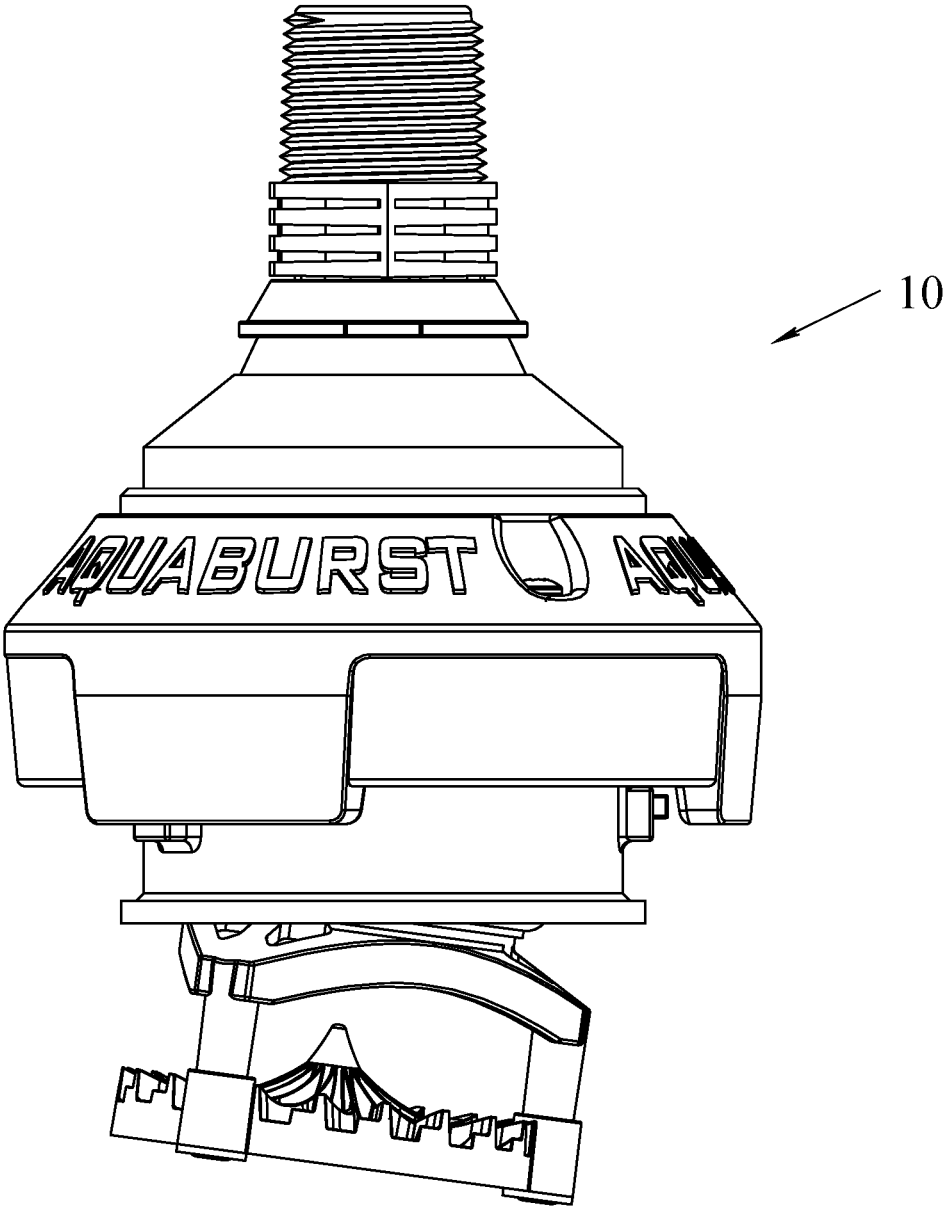
FIG. 1 is an elevation view of a first embodiment of a sprinkler head.

The purpose of the Summary is to enable the public, and especially the scientists, engineers, and practitioners in the art who are not familiar with patent or legal terms or phraseology, to determine quickly from a cursory inspection, the nature and essence of the technical disclosure of the application. The Summary is neither intended to define the inventive concept(s) of the application, which is measured by the claims, nor is it intended to be limiting as to the scope of the inventive concept(s) in any way.

Disclosed is a fluid distributing sprinkler head that has a sprinkler body and a spool assembly configured to nutate within the sprinkler body. The spool assembly includes a spool having a central bore and a distribution disc attached by one or more arms to the spool. The spool assembly is configured to nutate within the sprinkler body when fluid is sprayed from a nozzle through the central bore of the spool of and onto the distribution disc.

The sprinkler body has a sprinkler upper body which partially encloses a fluid delivery tube that supplies fluid to the nozzle. Fluid flows through the fluid delivery tube and exits out the nozzle, which defines a fluid path by constricting the supplied fluid to form a narrow stream of fluid. The nozzle is preferably removable from the sprinkler head so as to be replaceable. A variety of nozzle sizes can be utilized with the sprinkler head.

The spool has a generally cylindrical shape and is positioned below the sprinkler upper body and centered on the fluid delivery tube and nozzle. The spool has a central bore that allows for fluid sprayed by the nozzle to pass through it. The distribution plate has a generally peaked surface with the peak centered on the top face of the distribution plate and spirally radiating grooves extending from the peak. As fluid sprayed from the nozzle impinges on the distribution plate, the fluid flows out one or more of the spirally radiating grooves causing the spool assembly to tilt and rotate. As the distribution plate rotates, the fluid impinges in an adjacent spirally radiating groove and forces the spool assembly to tilt in a slightly offset direction as it continues to rotate. In this manner the spool assembly rocks as it rotates, or nutates.

A sprinkler lower body extends from the sprinkler upper body and fully circumvolves the spool. In a preferred embodiment the sprinkler lower body is removably connected to the sprinkler upper body for maintenance or repair. In another preferred embodiment the sprinkler lower body is fixedly connected to the sprinkler upper body. In a further preferred embodiment the sprinkler upper body and the sprinkler lower body are one part.

The spool has an upper friction band and a lower friction band mounted on the spool. Preferably the upper and lower friction bands are removably connected to the spool's annular profiles so as to be replaceable, or they can be integrally molded or connected to the spool. Preferably the friction bands are wearable friction bands. The friction bands can be constructed, for example, of a urethane material, rubber, hard plastic, or any material that would serve as a friction band. The sprinkler lower body forms an upper race and a lower race for the upper and lower friction bands respectively. As the spool assembly nutates, the races are configured such that the outer diameter of each friction band rolls radially on the inner diameter of the races to limit the angle at which the spool assembly nutates. The outer diameter of each friction band is referred to as being the diameter through the center of the spool on which the friction band is located to the outermost perimeter of the friction band. The inner diameter of each race is the diameter measured through a center of the sprinkler housing. Preferably the ratio of the upper friction band outer diameter to the upper race inner diameter is the same as the lower friction band outer diameter to the lower race inner diameter to allow both friction bands to roll without forcing one or the other to slip or scrub on the race. The spool preferably has annular profiles positioned radially at distal ends of the spool at or near the top and bottom of the spool in which the friction bands are positioned.

In a preferred embodiment the upper and lower friction bands have a circular cross-section, for example as in an O-ring. In another preferred embodiment the upper and lower friction bands have a non-circular cross-section so as to prevent the friction band from rolling or twisting within the spool's annular profile. In a further preferred embodiment one or both of the friction bands can have geared teeth, and one or both of the races can have opposing geared teeth to prevent slipping between the friction bands and the races.

In a preferred embodiment the outer diameters of the upper and lower friction bands are equal. In another preferred embodiment the outer diameters of the upper and lower friction bands are not equal so as to have the center of rotation of the spool assembly closer to or coincident with the spool assembly's center of mass to further reduce vibration. In either embodiment the spool assembly can have a counterbalance weight attached to the top of the spool, and the spool can have weight-reducing features to further align the spool assembly's center of rotation and center of mass to minimize vibration.

The spool has an annular disc, and the sprinkler head has at least one raised projection that is indirectly connected to the sprinkler upper body. The at least one raised projection is configured to support the spool assembly by the annular disc so that the spool assembly hangs freely from the raised projection when fluid is not flowing through the sprinkler head and the sprinkler head is in a vertical position. Preferably the sprinkler has a pair of raised projections on opposite sides of the fluid path. Preferably the pair of raised projections are off-centered such that the spool assembly is tilted when the sprinkler head is not running. This initial tilt prevents the fluid sprayed from the nozzle from hitting in the center of the distribution plate which could cause the spool assembly to stall on startup.

In a preferred embodiment, the annular disc circumvolves the spool. The at least one raised projection extends from the sprinkler lower body. In a first preferred embodiment, the annular disc's lower face is coincident with the spool assembly's center of rotation. In another preferred embodiment the annular disc is formed between the spool and the upper annular profile. Preferably the at least one raised projection can be removably connected to the sprinkler lower body. Alternatively the at least one raised projection can be fixedly connected to or integrally molded with the sprinkler lower body.

In a preferred embodiment one or both of the upper and lower races can have a starter ramp configured as part or the race or extending from the race. When the sprinkler head is without fluid the spool assembly is loosely supported by the at least one raised projection, preferably in a titled orientation. When the sprinkler head is in an off position the spool rests in a tilted orientation on the at least one raised projection such that the upper friction band contacts the lower end of the starter ramp. As the sprinkler turns on and begins to impinge fluid on the distribution plate, the spool assembly begins to tilt and rotate contacting the lower friction band with the lower race. This is called the start position. As the spool assembly begins to nutate faster the centrifugal force of the spool assembly drives the friction band up the starter ramp until it contacts the race. When the friction bands have reached their races and are radially rolling in the races the sprinkler is in the running position.

A starter ramp can be positioned on or extending from the upper race, the lower race, or both. As used herein the starter ramp extending from the lower race or being configured as part of the race are used interchangeably, with any starter ramp that is configured to allow a friction band to move vertically into the running position of the race is in accordance with the inventive concepts disclosed herein.

Because the friction bands load on the races radially, the starter ramp is able to lift the spool assembly away from the at least one raised projection. This allows the at least one raised projection to be larger and tilt the spool assembly more than prior tilting mechanisms known to the inventors, while at the same time allowing for more clearance so the at least one raised projection is not contacted during operation, even likely after the friction bands are worn to the point of replacement.

In a preferred embodiment, one or both of the upper and lower races can have an upper-limiting face. The upper-limiting face limits the amount the spool assembly can lift while the sprinkler head is running. This serves to maintain the friction bands on their respective races when the sprinkler head is running.

The sprinkler head can have an optional weight, with a purpose of the weight being to dampen vibrations caused by nutation of the spool assembly and to help prevent wind from blowing the sprinkler head away from vertical when hung on flexible conduit.

In a preferred embodiment, a spool support tube is connected to the sprinkler upper body downstream of the fluid delivery tube, and has a center bore through which fluid can flow. In a preferred embodiment, the spool circumvolves the spool support tube and has the annular disc centrally located within the spool. The annular disc has an aperture through which the spool support tube is located. The aperture is slightly larger than the spool support tube to allow the spool to freely nutate around the spool support tube, but the aperture is small enough to prevent the spool from excessive misalignment when the spool assembly is at rest. In this embodiment the spool support tube has at least one raised projection to support the spool assembly from the annular disc when fluid is not flowing through the sprinkler.

In a preferred embodiment, the nozzle is connected to the fluid supply tube above the spool support tube, and the spool support tube at least partially surrounds the fluid path defined by the nozzle.

In another preferred embodiment, the nozzle is connected to the spool support tube at the downstream end of the support tube, and the nozzle, spool support tube, and fluid delivery tube are all fluidly connected. In this embodiment the nozzle is located below the lower end of the spool, and is easily removable for maintenance or to be exchanged with a different nozzle.

In a preferred embodiment the spool has a general shape of a cylindrical hourglass, having a wider top and bottom with a narrower waist. Preferably in this embodiment the annular disc is positioned at or near the waist of the cylindrical hourglass shape of the spool. The annular disc can be positioned either internally or externally on the spool. The friction bands are positioned at distal ends of the spool, at or near the top and bottom of the spool.

In another preferred embodiment a lower portion of the spool has a general bell shape. Preferably in this embodiment the annular disc is positioned at or proximate to the top of the spool. Preferably in this embodiment the friction band is positioned on an edge of the annular disc, preferable in an annular profile formed at an edge of the disc.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature.

DETAILED DESCRIPTION OF THE EXEMPLARY EMBODIMENTS

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined in the claims.

A first embodiment of the disclosed technology is shown FIGS. 1 through 11*b*. FIG. 1 shows the disclosed sprinkler head in what is called a vertical orientation. The sprinkler head can operate in an inverted orientation, but the orientation shown in the figures will be termed vertical, as regards parts with a "top" side or a "bottom" side.

Figure 2:
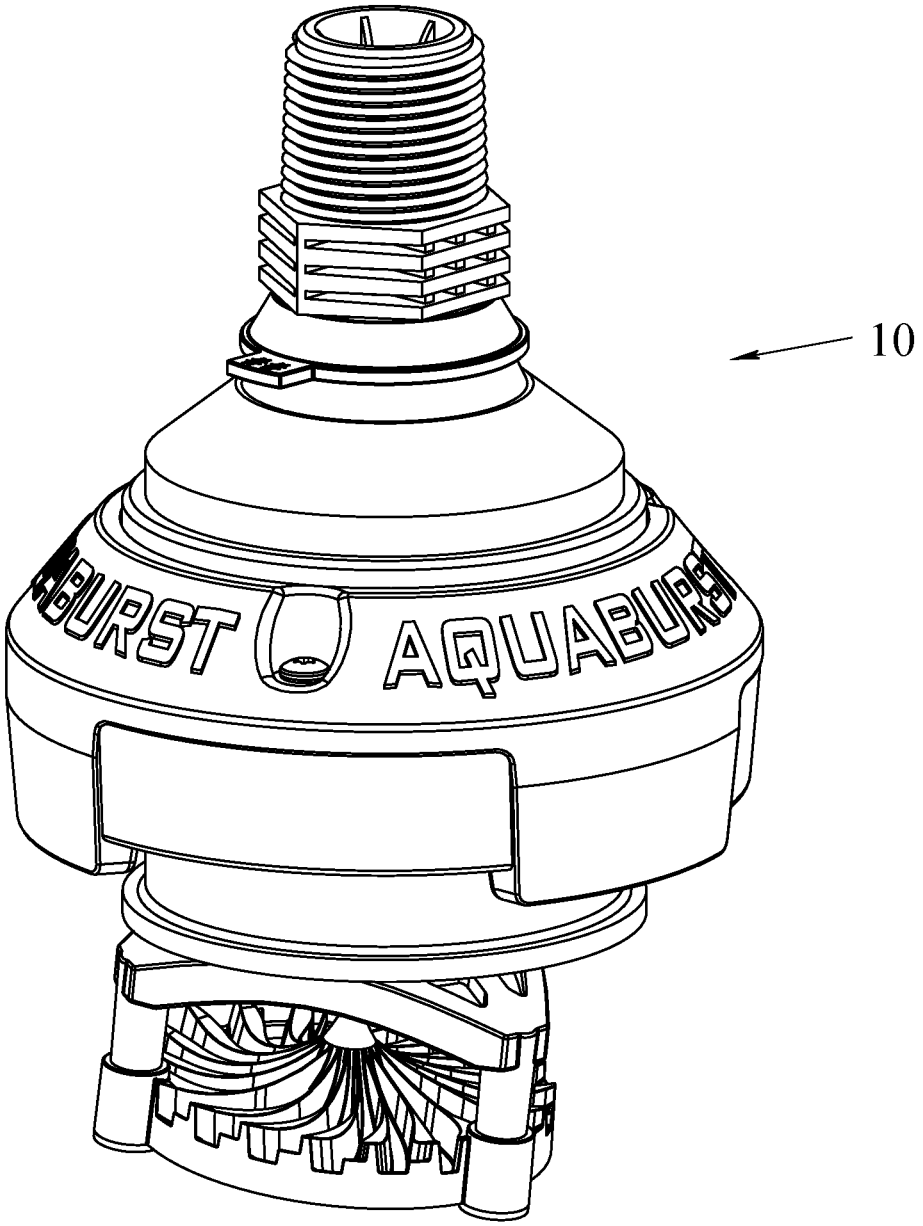
FIG. 2 is a perspective view of a first embodiment of a sprinkler head.

FIG. 1 illustrates a sprinkler head 10 in an elevational view. A spool assembly 20 is shown housed in a sprinkler body 15. The sprinkler head is in an off position with the spool assembly hanging at an angle within the sprinkler head. FIG. 2 illustrates a perspective view of the sprinkler head of FIG. 1.

Figure 3:
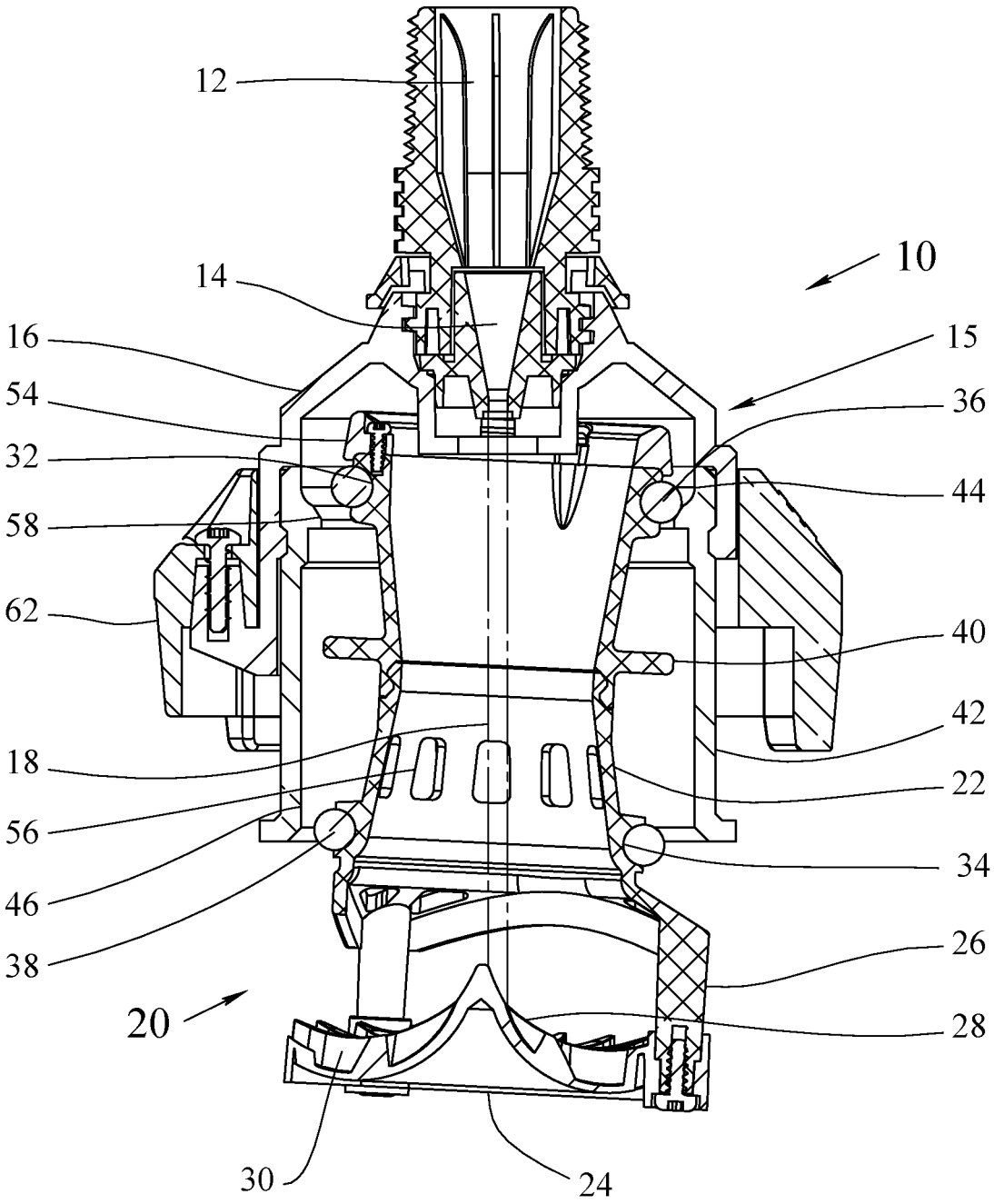
FIG. 3 is a cross sectional view of a first embodiment of a sprinkler head in the off position.

FIG. 3 is a cross-sectional view of the embodiment of the sprinkler head illustrated in FIG. 1. The sprinkler head is shown in an off position. The sprinkler head has a fluid delivery tube 12 that provides fluid to a nozzle 14 positioned at the end of the fluid delivery tube. The nozzle is configured to direct a spray of fluid at a distribution plate 24. The nozzle is configured to direct the spray of fluid along fluid trajectory path 18 through the sprinkler body 15. In the depicted embodiment the sprinkler body is formed in two connected sections, the sprinkler upper body 16 and the sprinkler lower body 42. In the depicted embodiment the fluid delivery tube 12 is attached to the sprinkler upper body 16.

In the depicted embodiment, a sprinkler weight 62 is attached to the sprinkler upper body. The sprinkler weight can be made of a variety of materials, including metal, glass, or plastic filled with weighted material with a weight-providing material like sand, or other material known or to be known to those skilled in that art. The sprinkler lower body 42 extends from the sprinkler upper body. The spool assembly includes a spool 22 that is attached via one or more arms 26 to the distribution plate 24. In the first preferred embodiment the spool has a generally cylindrical shape in the general shape of an hourglass, having a wider top and bottom and a narrower waist. The spool assembly is configured to hang freely within the sprinkler body when fluid is not being sprayed from the nozzle through the sprinkler body and onto the distribution plate. The spool has an upper friction band 36 and a lower friction band 38 positioned at or near opposing distal ends of the spool. The upper friction band is positioned within an upper annular profile 32 configured on an outer surface of the spool. The lower friction band is configured within a lower annular profile 34 configured in an outer surface of the spool. As the spool hangs freely the upper friction band is positioned against the lower end of a starter ramp 58.

The distribution plate has a generally peaked surface 28 from which spirally radiating grooves 30 extend outward. As fluid is sprayed from the nozzle onto the distribution plate, the fluid flows out one or more of the spirally radiating grooves, causing the spool assembly to tilt and rotate. As the spool tilts and rotates, the upper friction band moves upward into the upper race 44 and the lower friction band moves upward into a lower race 46. The upper friction band is configured such that as the spool assembly nutates within the sprinkler body, the outer diameter of the upper friction band rolls radially on the inner diameter of the upper race to limit the angle at which the spool assembly nutates. Similarly, the lower race is configured to limit the angle at which the spool assembly nutates by the outer diameter of the lower friction band rolling radially on the inner diameter of the lower race. The spool assembly in the depicted embodiment is configured with an optional counterbalance weight 54 attached to the top of the spool and weight-reducing features 56 that locates the center of mass of the spool assembly at the center of rotation of the spool assembly to reduce vibration. The weight-reducing features in the depicted embodiment are cutouts in the spool body that reduce the weight of the lower spool body.

Figure 4:
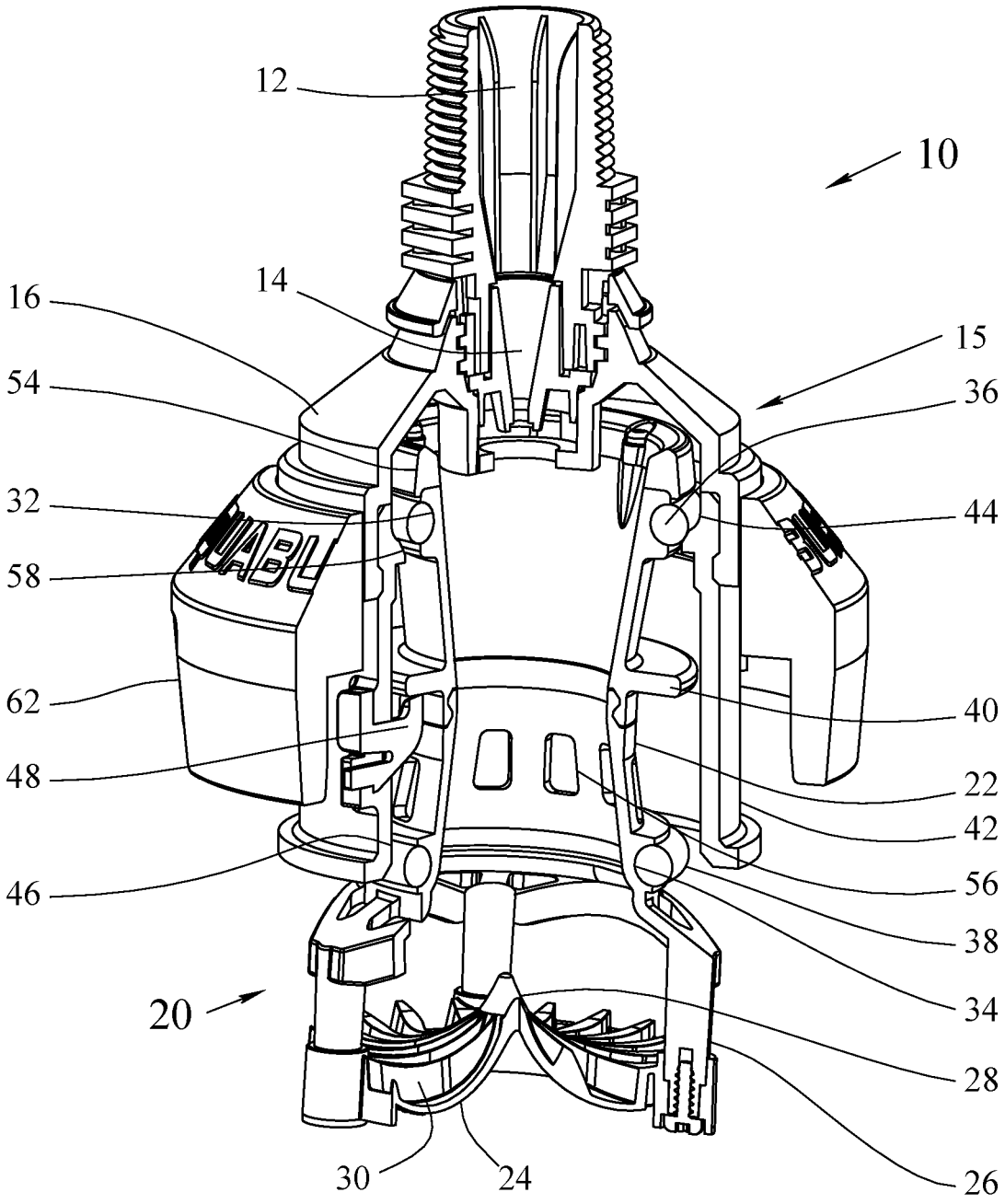
FIG. 4 is a partial cutaway perspective view of a first embodiment of a sprinkler head in the off position.

FIG. 4 illustrates a partial cutaway perspective view of the embodiment of the sprinkler head in the off position shown in FIGS. 1-3. The cutaway view illustrates a raised projection 48 extending from the sprinkler lower body. The raised projection is configured to interact with an annular disc 40 circumvolving the spool. The raised projection is configured such that when fluid is not being sprayed from the nozzle 14 onto the distribution plate 24, the spool hangs freely in the sprinkler body such that the annular disc 40 hangs on the raised projection 48 such that the spool is hanging at an angle. This facilitates starting of nutation when fluid is initially sprayed from the nozzle 14 onto the distribution plate 24.

Figure 5:
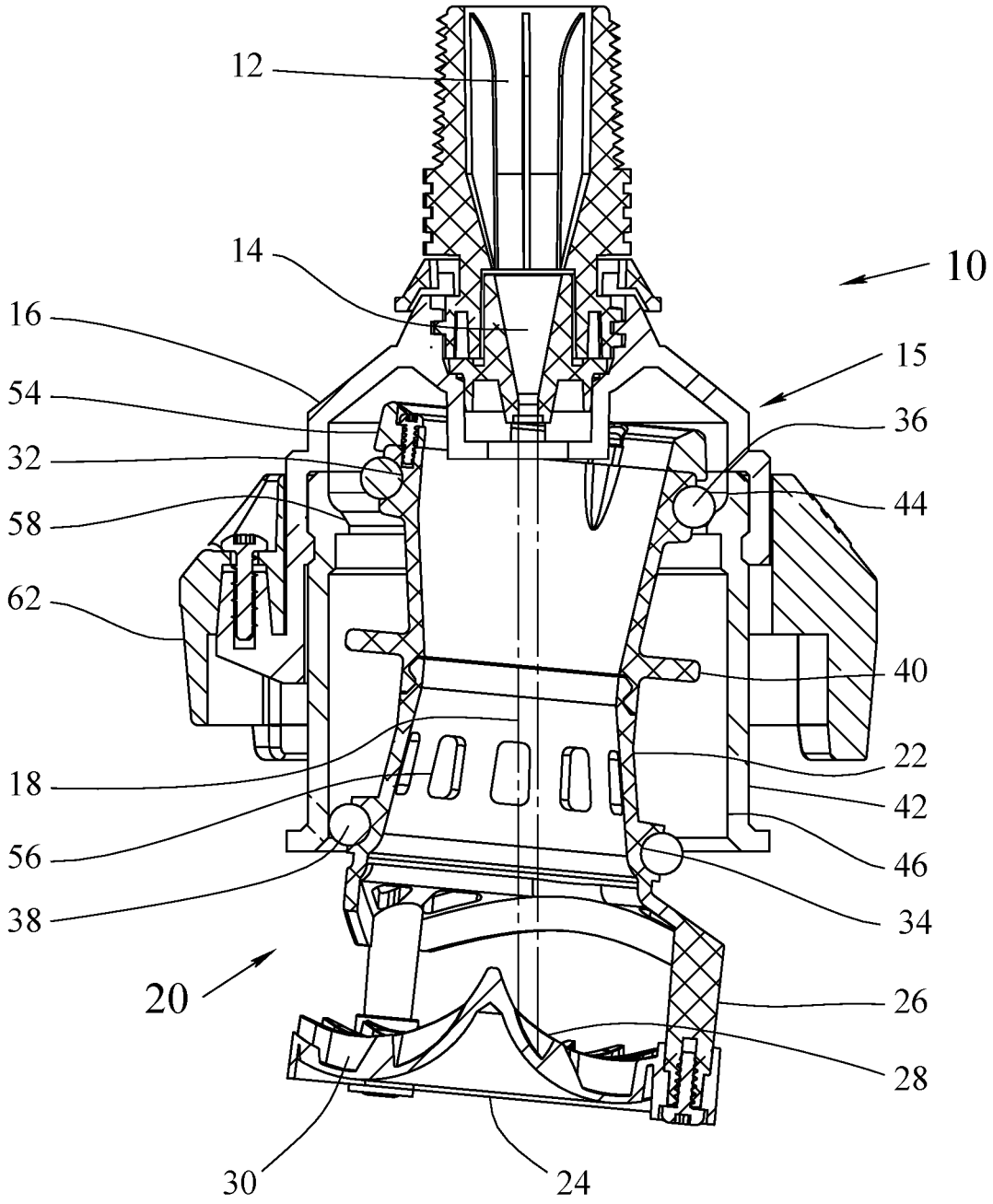
FIG. 5 is a cross sectional view of a first embodiment of a sprinkler head in the start position.
Figure 6:
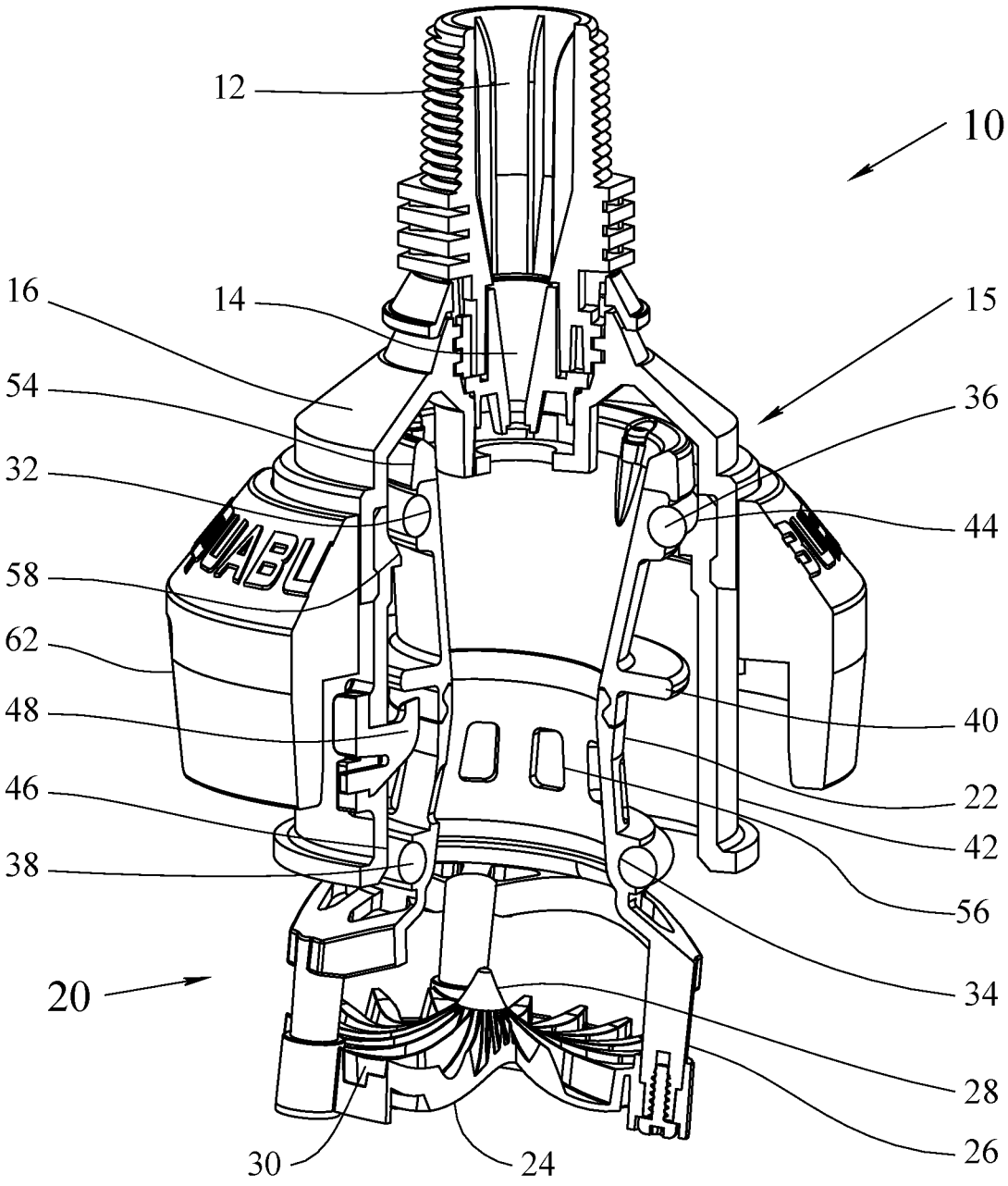
FIG. 6 is a partial cutaway perspective view of a first embodiment of a sprinkler head in the start position.

FIGS. 5 and 6 illustrate the sprinkler head in embodiment shown in FIGS. 1-4 in a starting position. In the starting position, fluid has begun spraying from the nozzle 14 onto the distribution plate 24. The spray of the fluid from the nozzle onto the distribution plate has caused the spool assembly 20 to begin to tilt up and nutate, within the sprinkler body. As illustrated in FIG. 6, as the spool assembly begins to tilt up the annular disc around the spool lifts off of the raised projection 48 until the lower friction band contacts the sprinkler lower body. As the spool assembly nutates the radial force of the upper friction band on the starter ramp lifts the spool assembly up until the upper friction band and lower friction band are in their respective races. The upper friction band is shown rotating upward along the starter ramp 58.

Figure 7:
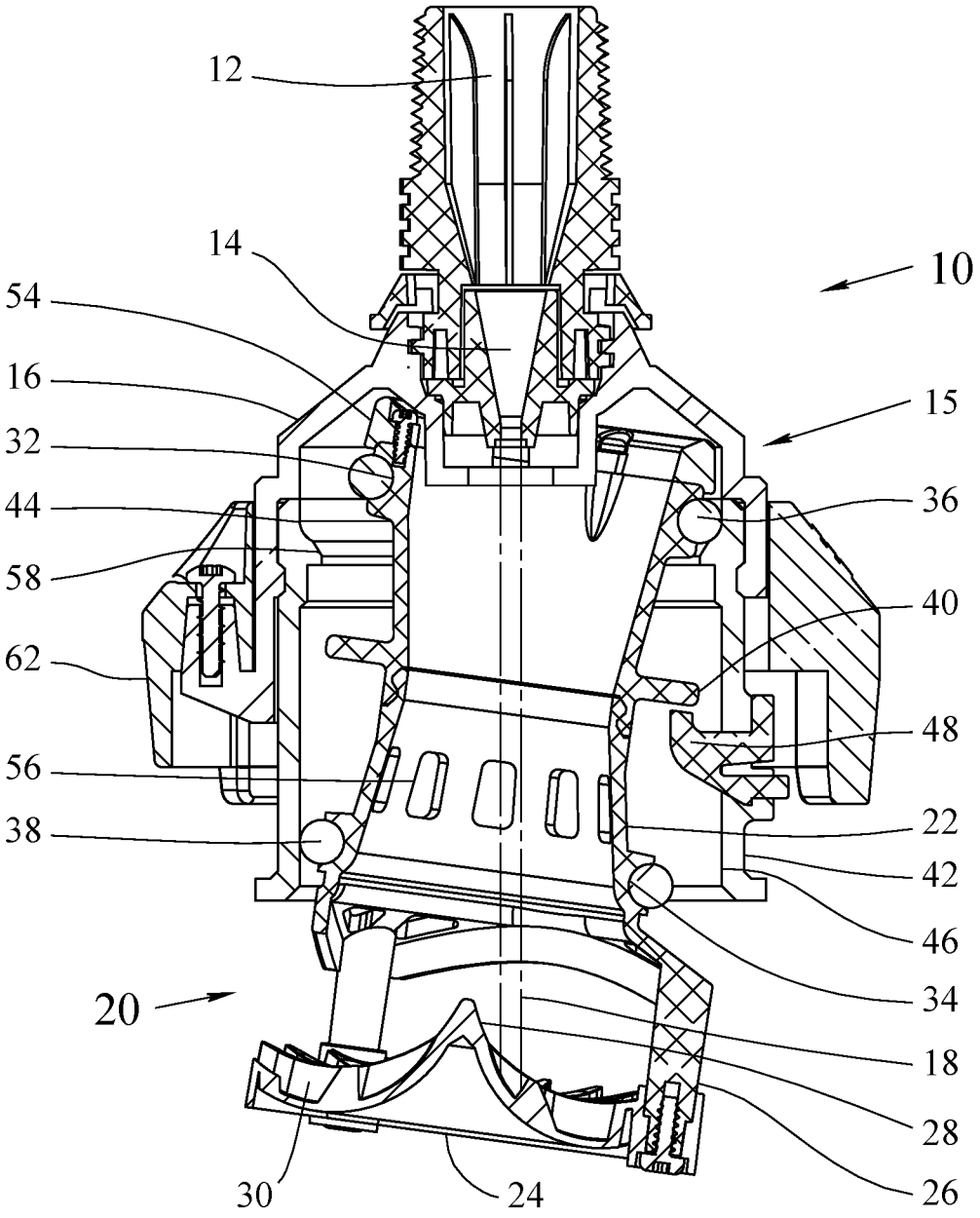
FIG. 7 is a cross sectional view of a first embodiment of a sprinkler head in the running position.
Figure 8:
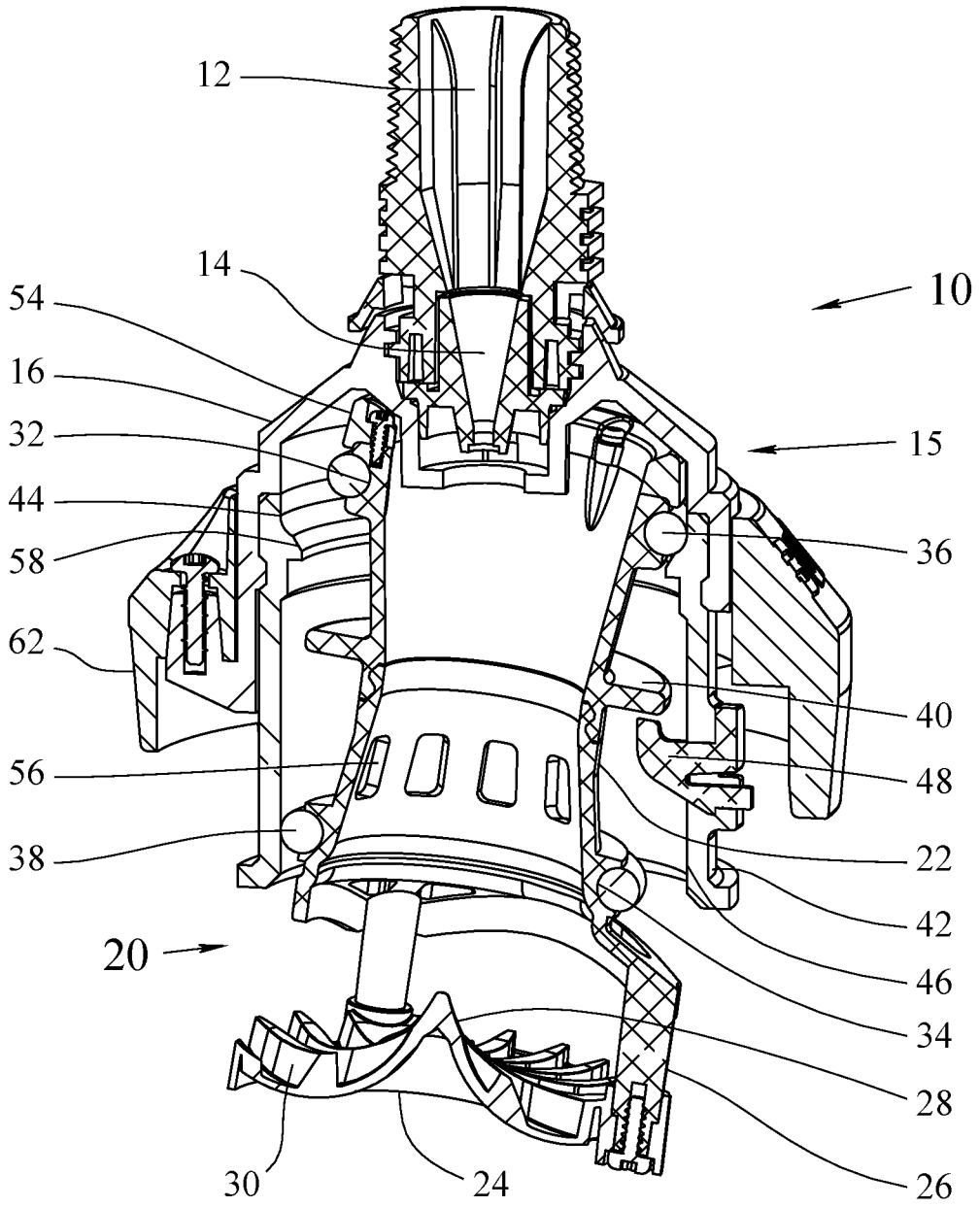
FIG. 8 is a perspective cross sectional view of a first embodiment of a sprinkler head in the running position.

FIGS. 7 and 8 illustrate the embodiment of a sprinkler head depicted in FIGS. 1-6 in a running position. In the running or on position, nutation is continuing as fluid is sprayed from the nozzle 14 onto the distribution plate 24 via flow fluid trajectory path 18. The upper friction band 36 and lower friction band 38 are radially rolling within or on their respective races.

Figure 9A:
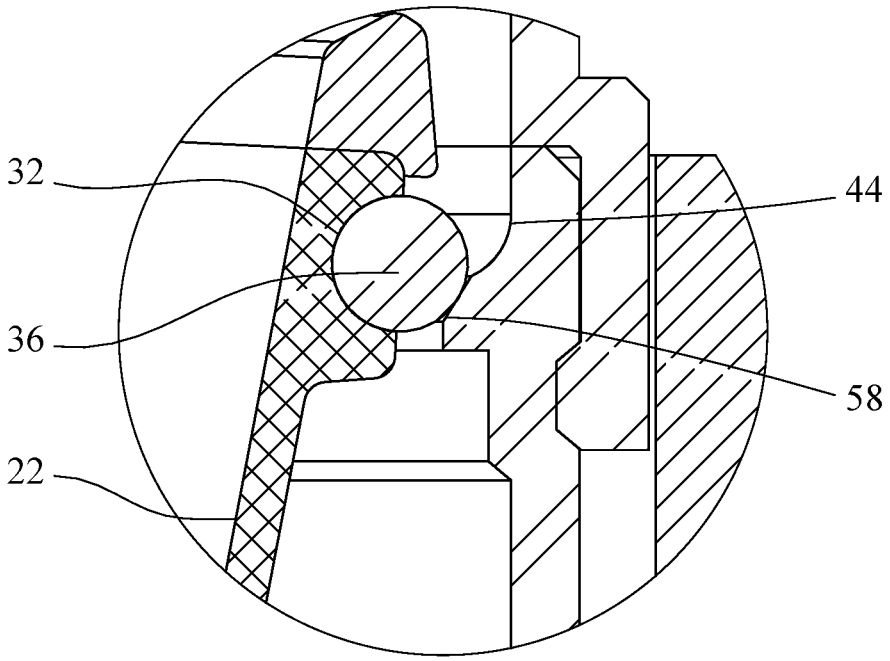
FIG. 9*a* is a detail cross sectional view of a friction band of a spool of a sprinkler head in the start position.
Figure 9B:
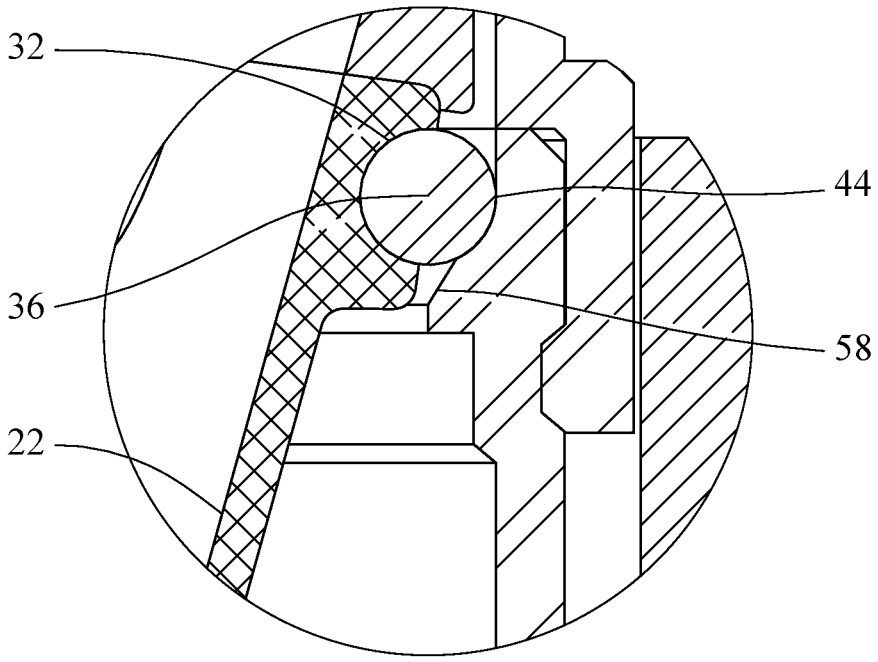
FIG. 9*b* is a detail cross sectional view of a friction band of a spool of a sprinkler head in the running position.

FIGS. 9A and 9B illustrate perspective cross-sectional views of the interaction between the upper friction band and the upper race of the sprinkler body of the embodiment of a sprinkler head shown in FIGS. 1-8. FIG. 9A illustrates a cross-sectional view of a spool friction band in the start position. In the start position, the upper wearable friction is resting against a starter ramp of the upper race. The starter ramp extends from the upper race and is configured such that the upper friction band drives up the starter ramp and into the upper race as nutation escalates. FIG. 9B illustrates the upper friction band 36 and upper race when the sprinkler head is in the running position. The upper friction band has moved upward into the upper race of the internal surface of the sprinkler body. The upper friction band continues radially rolling within the upper race as nutation and thus irrigation continues.

Figure 10:
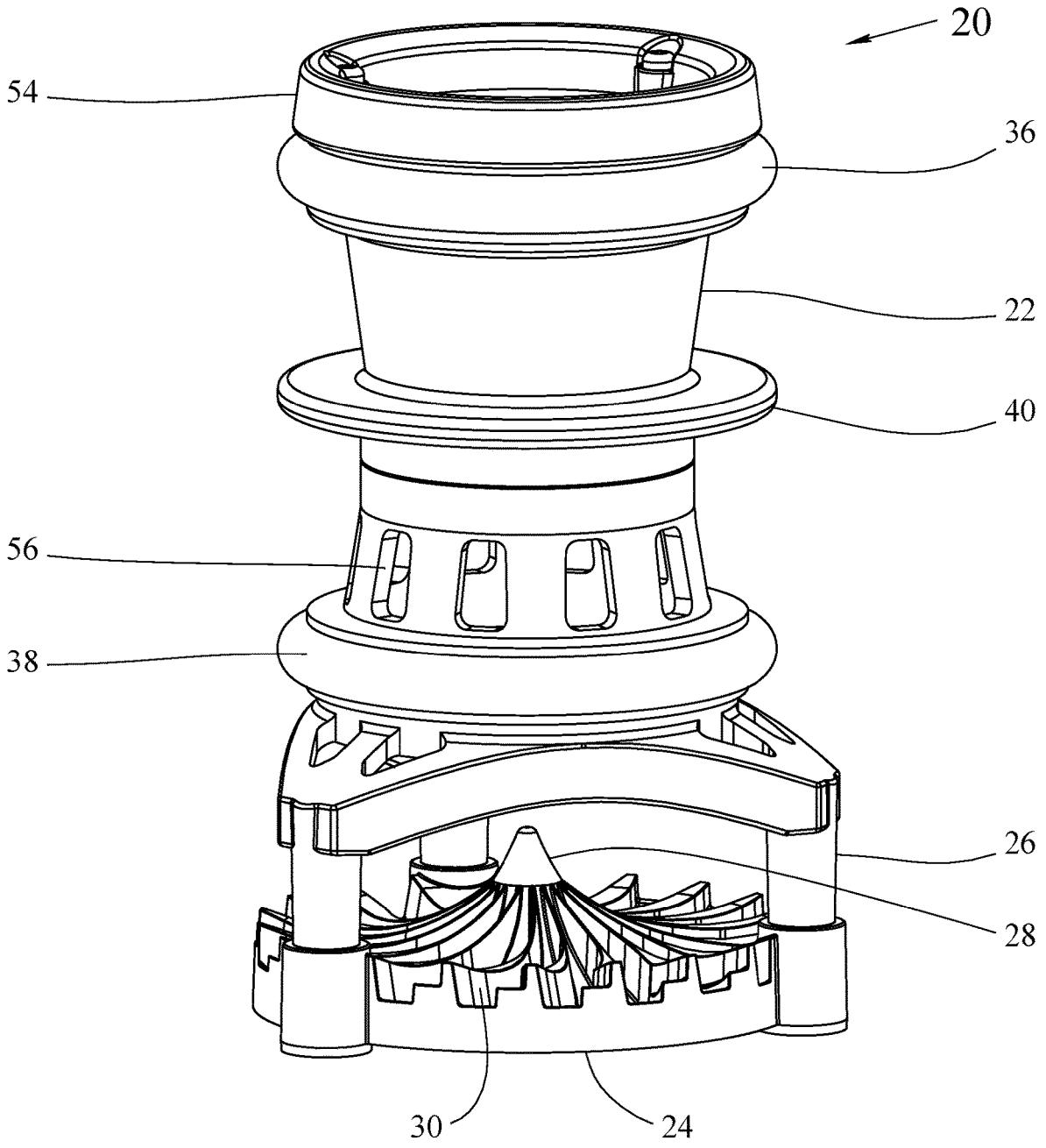
FIG. 10 is a perspective view of a first preferred embodiment of a spool assembly.

FIG. 10 illustrates a preferred embodiment of a spool assembly 20 as shown in FIGS. 1-9*b*. The spool assembly has a spool 22 attached to a distribution plate 24 by one or more arms 26. The spool has a generally cylindrical shape in the general shape of an hourglass, having a wider top and bottom and a narrower waist. The distribution plate has a generally peaked surface 28 with spirally radiating grooves extending outward from the peak to the edge of the distribution plate. The upper friction band 36 and lower friction band 38 are positioned in the depicted embodiment on opposite sides of the annular disc 40 circumvolving the spool. The depicted embodiment of the spool includes an optional weight-reducing feature 56 configured in the spool. A counterbalance weight 54 is positioned at the top of the spool. The counterbalance weight and weight-reducing feature locate the center of mass of the spool assembly closer to the center of rotation to reduce vibration of the sprinkler head.

Figure 11:
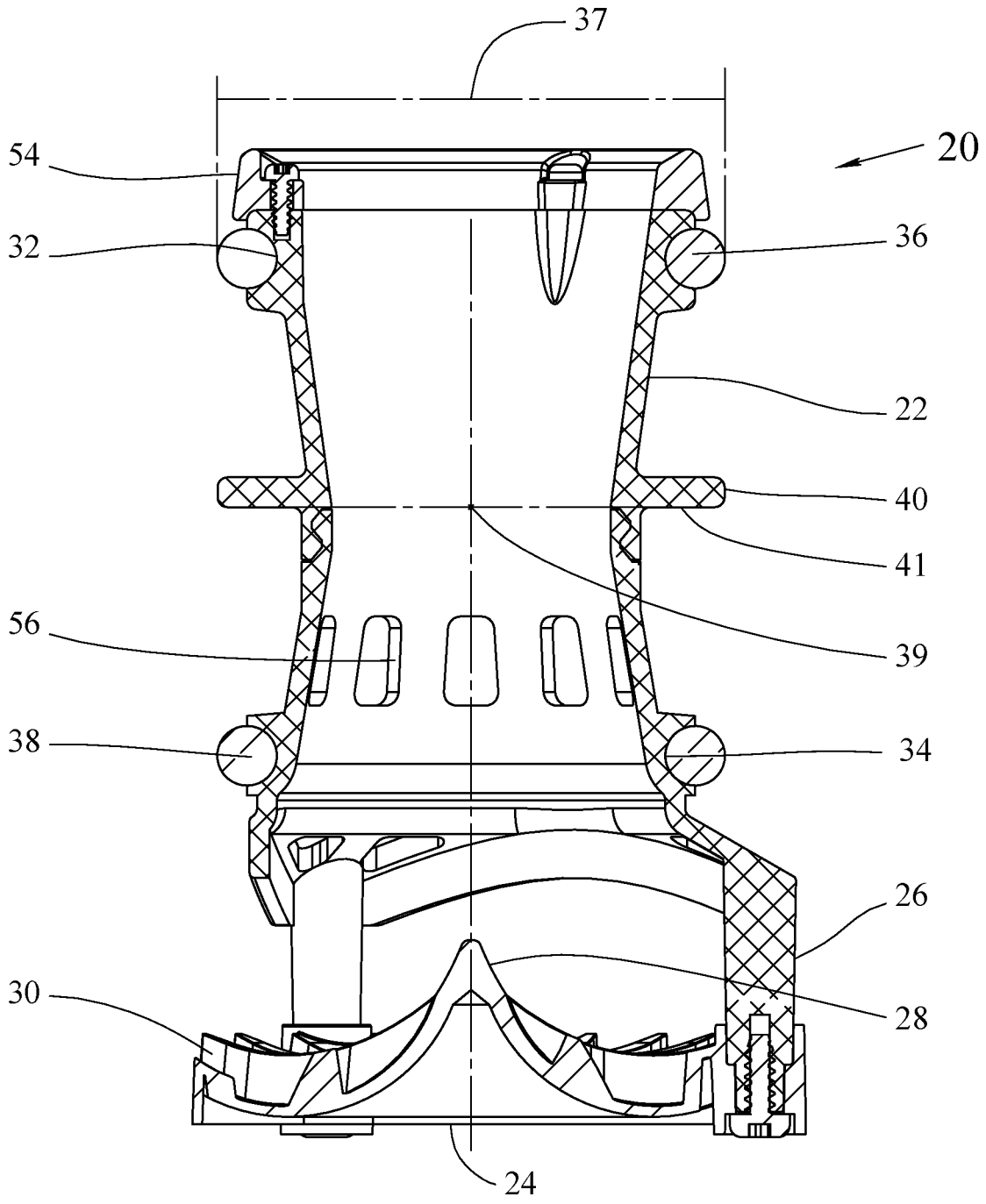
FIG. 11 is a cross sectional view of a first preferred embodiment of a spool assembly.

FIG. 11 illustrates a cross-sectional view of the spool assembly. FIG. 11 illustrates the upper friction band 36 positioned within the upper annular profile 32. The lower friction band 38 is positioned within the lower annular profile 34 of the spool. The outer diameter 37 of the upper friction band 36 is illustrated. The outer diameter of the lower friction band is measured in the same fashion as the outer diameter of the upper friction band. FIG. 11 further illustrates the center of rotation of the spool coincident with the lower face of the annular ring, as depicted at intersection 39. In the depicted embodiment the upper and lower annular profiles are formed on the surface of the spool.

Figure 11A:
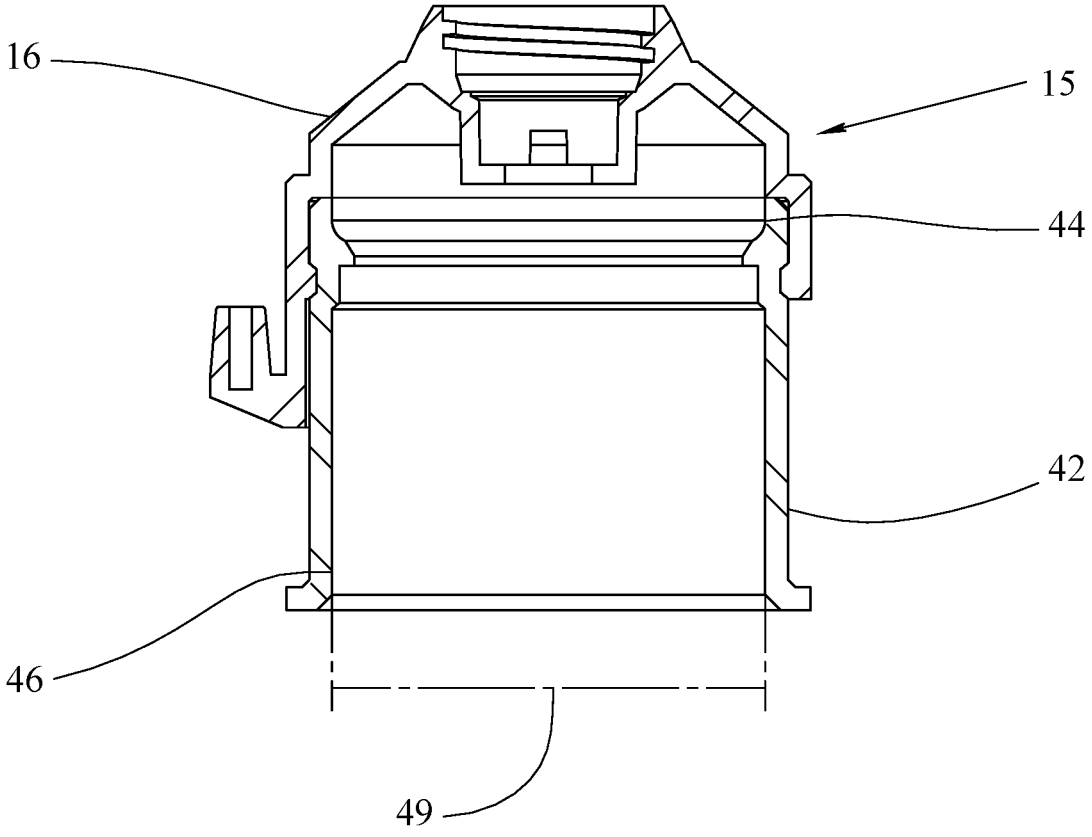
FIG. 11*a* is a cutaway view of an embodiment of a sprinkler body illustrating the inner diameter of the lower race.
Figure 11B:
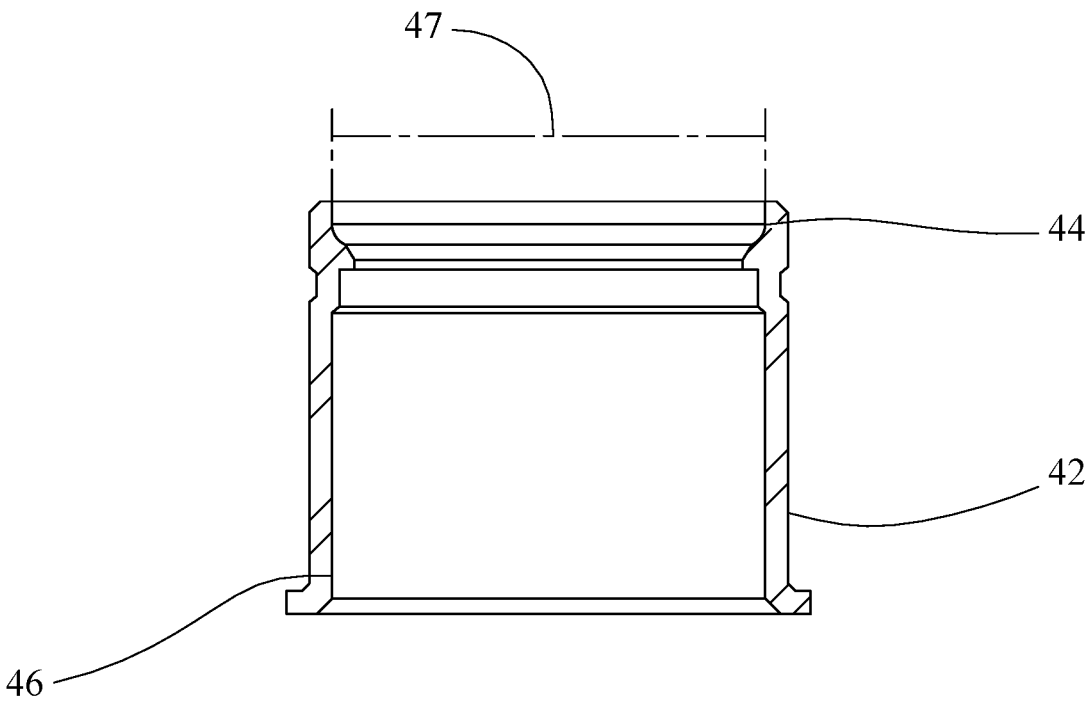
FIG. 11*b* is a cutaway view of an embodiment of a sprinkler lower body illustrating the inner diameter of the upper race.

FIG. 11*a* illustrates a cutaway view of a sprinkler body to depict the inner diameter 49 of the lower race 46 of the sprinkler lower housing. FIG. 11*b* illustrates a cutaway view of a sprinkler body to illustrate the inner diameter 47 of the upper race 44 of the sprinkler lower housing.

Figure 12:
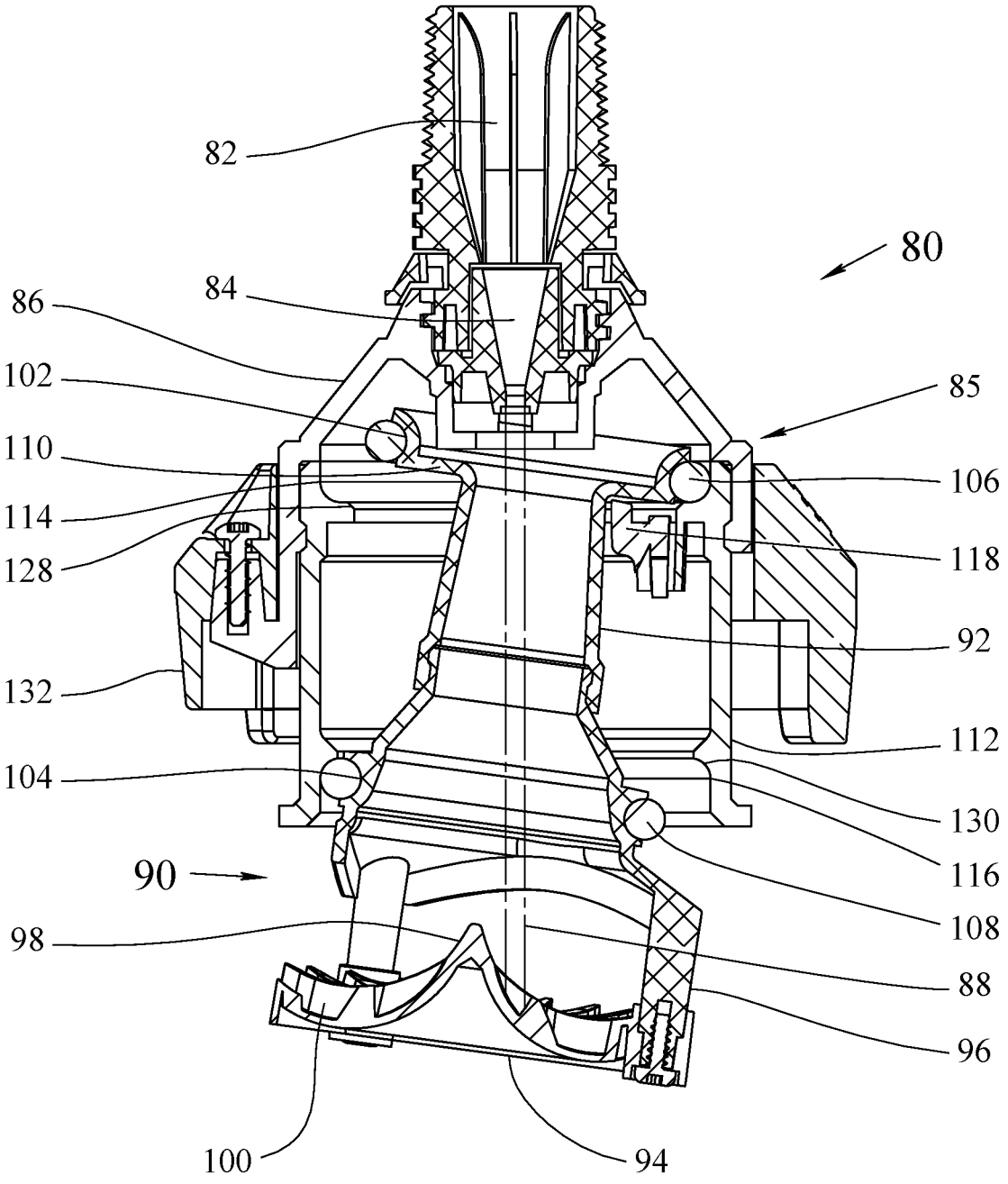
FIG. 12 is a cross sectional view of a second embodiment of a sprinkler head in the running position.
Figure 13:
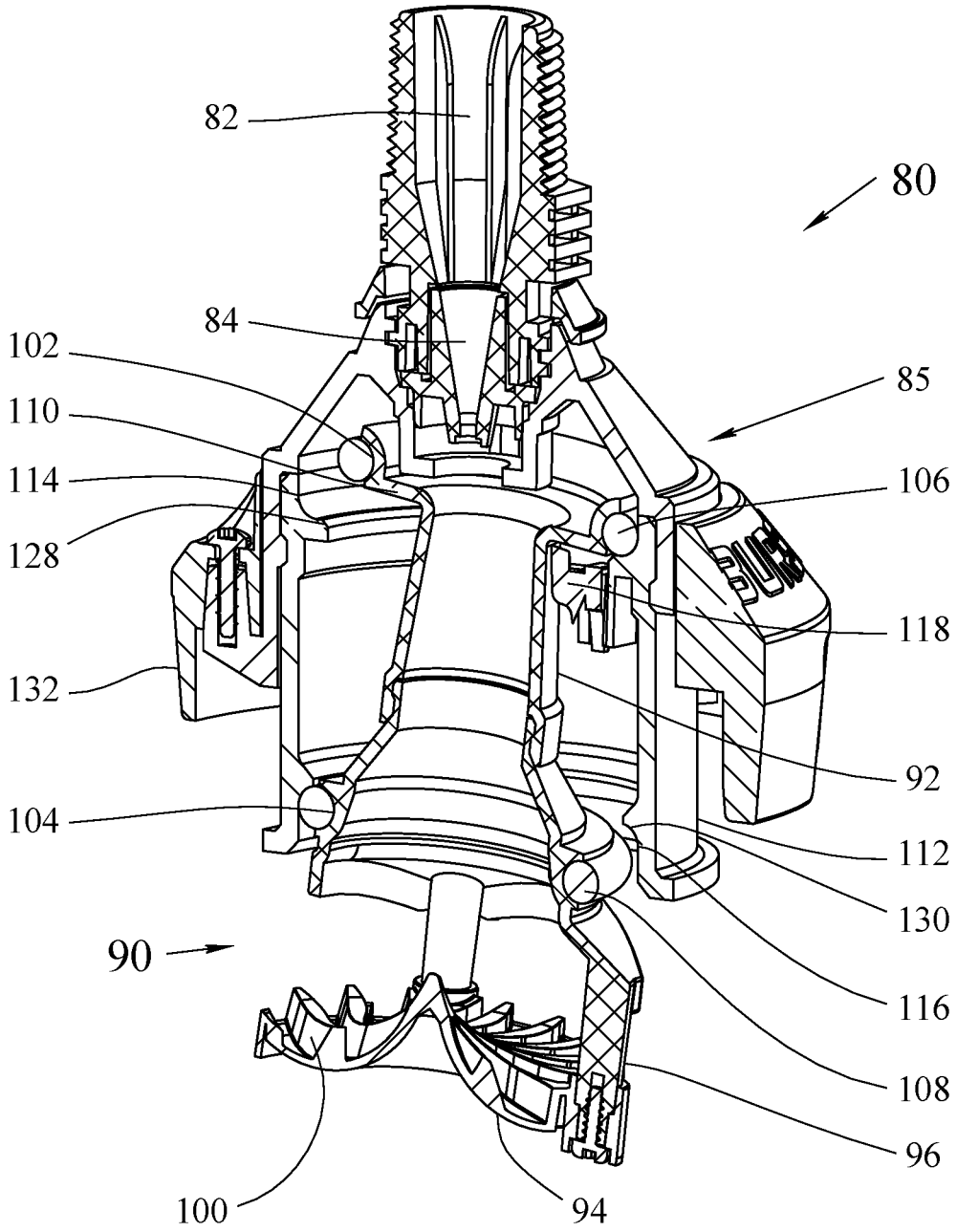
FIG. 13 is a perspective cross sectional view of a second embodiment of a sprinkler head in the running position.

FIGS. 12 and 13 illustrate a second embodiment of a sprinkler head 80 in which a spool assembly 90 is configured to nutate within a sprinkler body 85. A fluid delivery tube 82 configured to provide fluid to a nozzle 84. The nozzle is configured to spray fluid along fluid trajectory path 88 onto a fluid distribution plate 94. The fluid distribution plate 94 is attached via one or more arms 96 to the spool 92. In the depicted embodiment the spool has a generally cylindrical shape with a lower portion of the spool having a general bell shape. The fluid distribution plate has a generally peaked surface 98 and spirally radiating grooves 100 extending from the generally peaked surface. The sprinkler body 85 has a sprinkler upper body 86 and a sprinkler lower body 112. The sprinkler upper body and sprinkler lower body can be formed as separate pieces or can be formed as a uniform sprinkler body. An optional sprinkler weight 132 is attached to the sprinkler body.

In the depicted embodiment, the sprinkler lower body 112 has an upper race 114, and a lower race 116. A starter ramp 128 extends from the lower edge of the upper race. The lower race 116 has an upper limiting face 130. The upper limiting face of the lower race provides a limit as to the upward movement of the spool assembly 90 during nutation. In the embodiment depicted in FIGS. 12 and 13, the starting projection 118 or raised projection is removably connected to the sprinkler lower body 112. The raised projection is configured to support the annular disc 110 of the spool assembly. The annular disc is located at or near the top of the spool. In the depicted embodiment, the upper annular profile 102, is formed at an outer circumference of the annular disc 110.

An upper friction band 106 is positioned within an upper annular profile 102 of the spool. The upper friction band 106 is configured to radially roll within the upper race 114 as nutation occurs. A lower friction band 108 is positioned within a lower annular profile 104 of the spool. The lower friction band is configured to radially roll within the lower race 116 as nutation occurs. The upper friction band and lower friction band are positioned at distal ends of the spool, namely the top and bottom of the spool. The upper friction band and lower friction band are separated at a sufficient distance on the spool to allow the upper friction band and lower friction band to radially roll on their respective races when the spool assembly is nutating within the sprinkler body.

FIG. 13 illustrates a perspective cross sectional view of the second embodiment of the sprinkler head depicted in FIG. 12. FIG. 13 illustrates that the annular disc 110, of the spool assembly is not contacting the raised projection 118, when the when the spool assembly 90 is nutating, within the sprinkler body 80. The spool assembly 90 includes the spool 92 attached to the distribution plate 94 by one or more arms 96.

Figure 14:
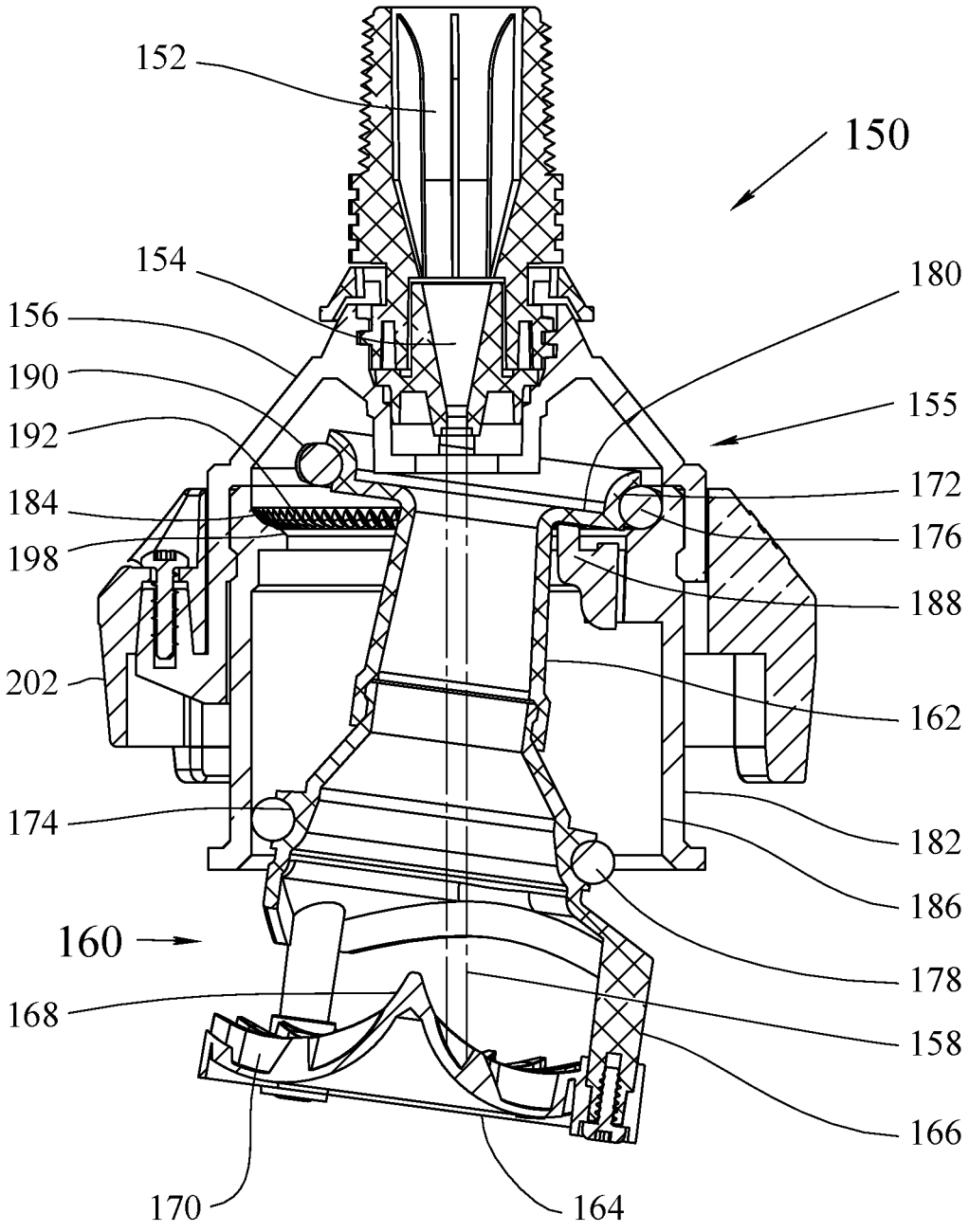
FIG. 14 is a cross sectional view of a third embodiment of a sprinkler head in the running position.
Figure 15:
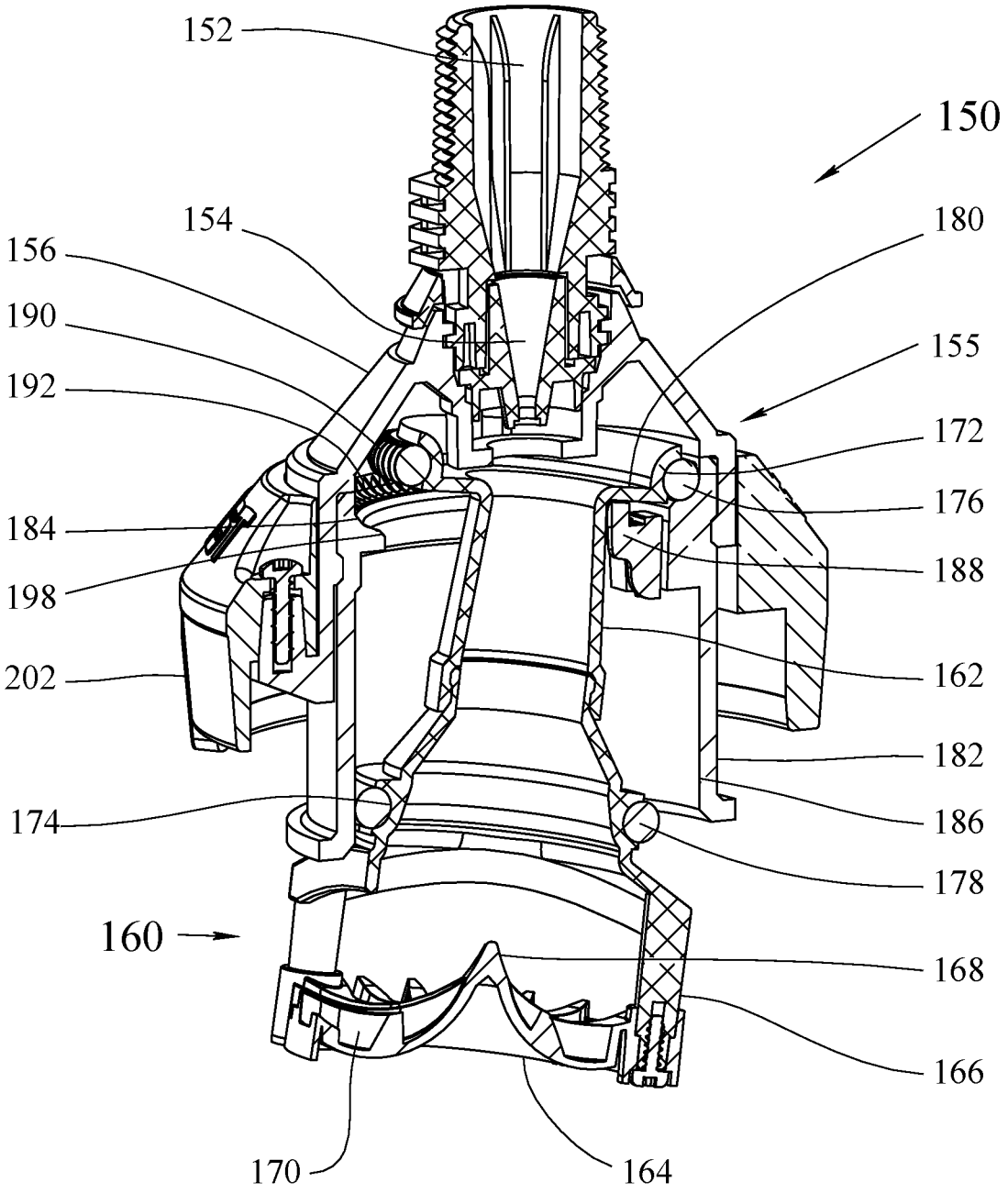
FIG. 15 is a perspective cross sectional view of a third embodiment of a sprinkler head in the running position.

FIGS. 14 and 15 illustrate cross sectional views of a third embodiment of a sprinkler head 150 in the running position. FIG. 14 illustrates a fluid delivery tube 152, through which fluid is provided to a nozzle 154. When the sprinkler head is operating, the nozzle sprays fluid along fluid trajectory path 158 onto a fluid distribution plate 164. The fluid distribution plate has a generally peaked surface 168 and spirally radiating grooves 170, extending from the peak.

The fluid delivery tube is attached to a sprinkler body 155. The sprinkler body is made up of a sprinkler upper body 156 and a sprinkler lower body 182. A spool assembly 160, is configured to nutate within the sprinkler body housing. The sprinkler body housing has an upper race 184 and a lower race 186. In the depicted embodiment, the upper race has a series of race gear teeth 192 that are configured to interact with a series of friction band gear teeth 190 positioned on an outer surface or integral with an upper friction band 176 of the spool assembly. A starter ramp 198 is positioned as formed as a portion of the upper race 184. The raised projection 188 is removably connected to the sprinkler lower body 182. The raised projection 188, is configured such that in the off position, the annular disc 180, hangs from the raised projection 188.

The spool assembly 160 is made up of a spool 162, distribution plate 164, and one or more spool arms 166 connecting the distribution plate to the spool. The sprinkler body assembly in the depicted embodiment, has a sprinkler weight 202, attached there to. In depicted embodiment of FIGS. 14 and 15, an upper friction band is positioned within an upper annular profile 172 positioned on the annular disc 180. A lower friction band 178 is positioned within a lower annular profile 174 of the spool.

FIG. 15 illustrates a perspective cross sectional view of the embodiment shown in FIG. 14. FIG. 15 further illustrates the definition of the gear teeth 190 of the upper friction band. The gear teeth are configured to interact with the gear teeth 192 of the upper race.

Figure 16:
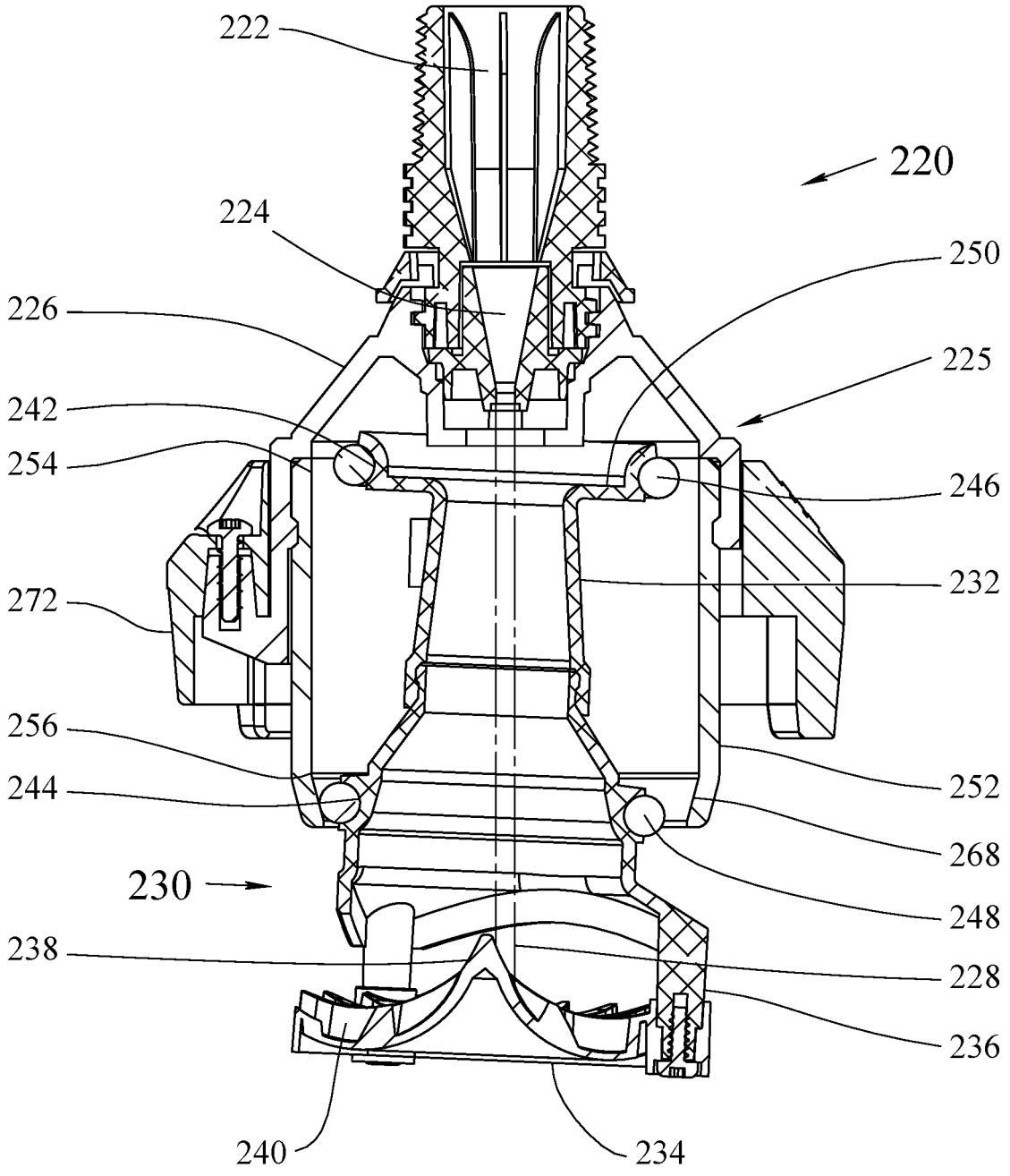
FIG. 16 is a cross sectional view of a fourth embodiment of a sprinkler head in the off position.

FIGS. 16 through 19 illustrate a fourth embodiment of a sprinkler head 220. FIG. 16 illustrates the fourth embodiment in the off position. The sprinkler head has a sprinkler body 225 and a spool assembly 230 housed within the sprinkler body and configured to nutate within the sprinkler body to distribute fluid from the sprinkler head. An optional sprinkler weight 272 is attached to the exterior of the sprinkler body. The sprinkler head has a fluid delivery tube 222 configured to deliver fluid to a nozzle 224. The nozzle is configured to spray fluid in a stream along fluid trajectory path 228 through a central bore of the spool 232 and onto the fluid distribution plate 234. The distribution plate has a generally peaked surface 238 and spirally radiating grooves 240 configured to distribute the fluid from the nozzle in a wetting pattern.

The sprinkler body 225 has a sprinkler upper body 226 and a sprinkler lower body 252. The sprinkler body has an upper race 254 and lower race 256 on an interior surface of the sprinkler body. A starter ramp 268 extends beneath the lower race. A spool assembly 230 is configured to nutate within the sprinkler body. The spool assembly includes a spool 232, a fluid distribution plate 234, and one or more spool arms 236 attaching the distribution plate to the spool. In the depicted embodiment the spool has a generally cylindrical shape with a lower portion of the spool having a general bell shape. The spool has a lower friction band 248 positioned within a lower annular profile 244 of the spool. The upper friction band and lower friction band are positioned at distal ends of the spool, namely the top and bottom end of the spool.

The sprinkler head is configured such that when the sprinkler head is on, the upper friction band of the spool radially rolls within the upper race and the lower friction band radially rolls within the lower race. In the depicted embodiment, the upper friction band 246 is positioned within an upper annular profile 242 formed at an outer edge of an annular disc 250 formed as a part of the spool or attached to the spool. The annular disc is configured to rest at an angle on the raised projection 258 when the sprinkler is in the off position. This provides a tilt to the spool assembly when the sprinkler is in the off position and facilitates initiation of nutation.

Figure 17:
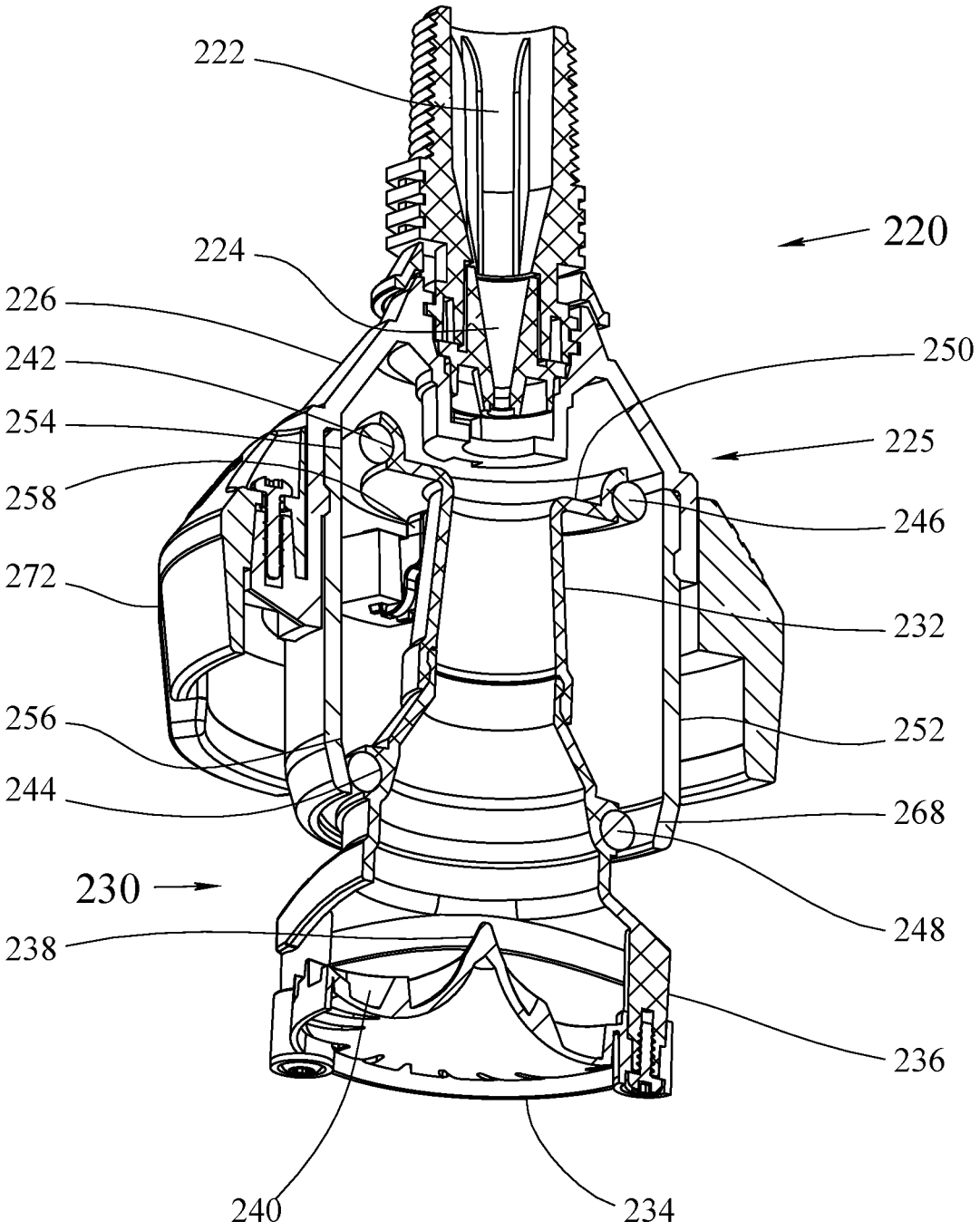
FIG. 17 is a perspective cross sectional view of a fourth embodiment of a sprinkler head in the off position.

FIG. 17 illustrates a perspective cross sectional view of the fourth embodiment in the off position. FIG. 17 further illustrates the raised projection 258 extending from an inner surface of the sprinkler lower body. The raised projection can be formed integrally with or attached to an inner surface of the sprinkler body.

Figure 18:
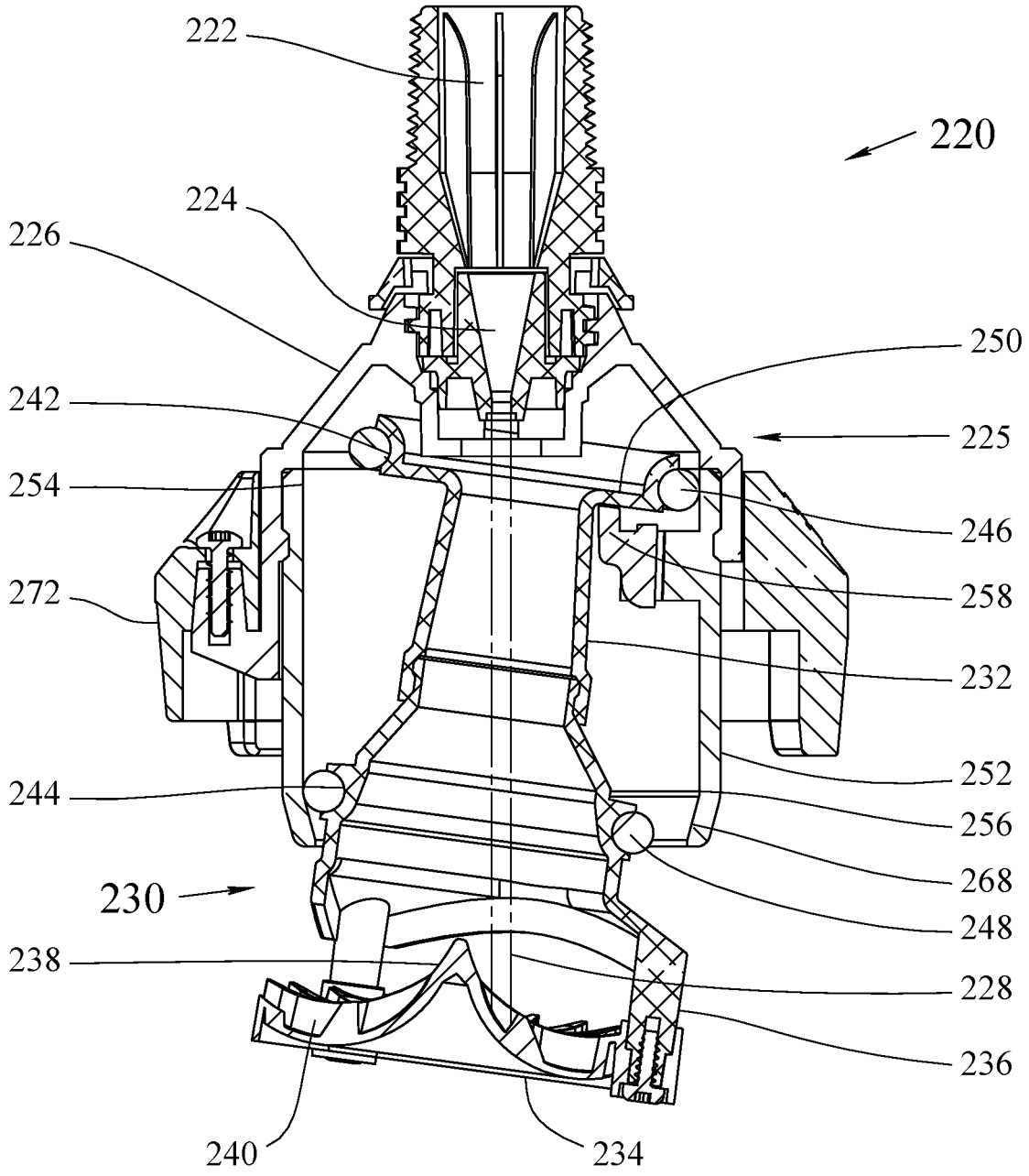
FIG. 18 is a cross sectional view of a fourth embodiment of a sprinkler head in the running position.

FIG. 18 is a cross sectional view of the fourth embodiment of the sprinkler head in a running position. In the running position, the upper and lower friction bands are radially rolling on the inner surfaces of their respective races. FIG. 18 illustrates that the term race can refer to the surface of the sprinkler body upon which a friction band radially rolls. This race can be formed with or without definition. As the spool assembly nutates within the sprinkler body the friction bands radially roll within their respective races, with the annular disc positioned above the raised projection so as to not contact the raised projection during full nutation.

Figure 19:
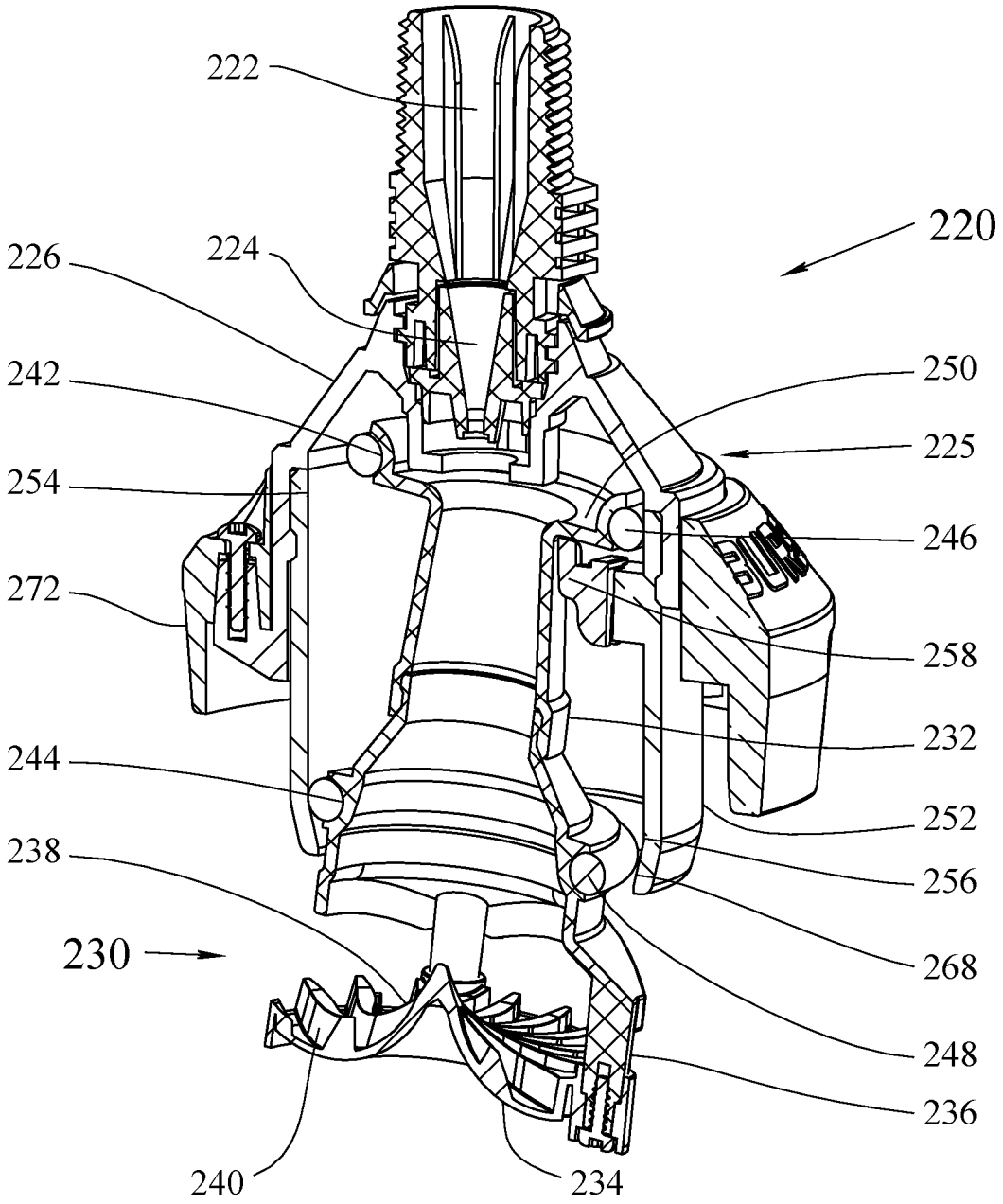
FIG. 19 is a perspective cross sectional view of a fourth embodiment of a sprinkler head in the running position.

FIG. 19 illustrates a perspective cross sectional view of the fourth embodiment of the sprinkler head in a running position. FIG. 19 illustrates the upper friction band 246 radially rolling along the upper race 254. Lower friction band 248 is radially rolling along lower race 256.

Figure 20:
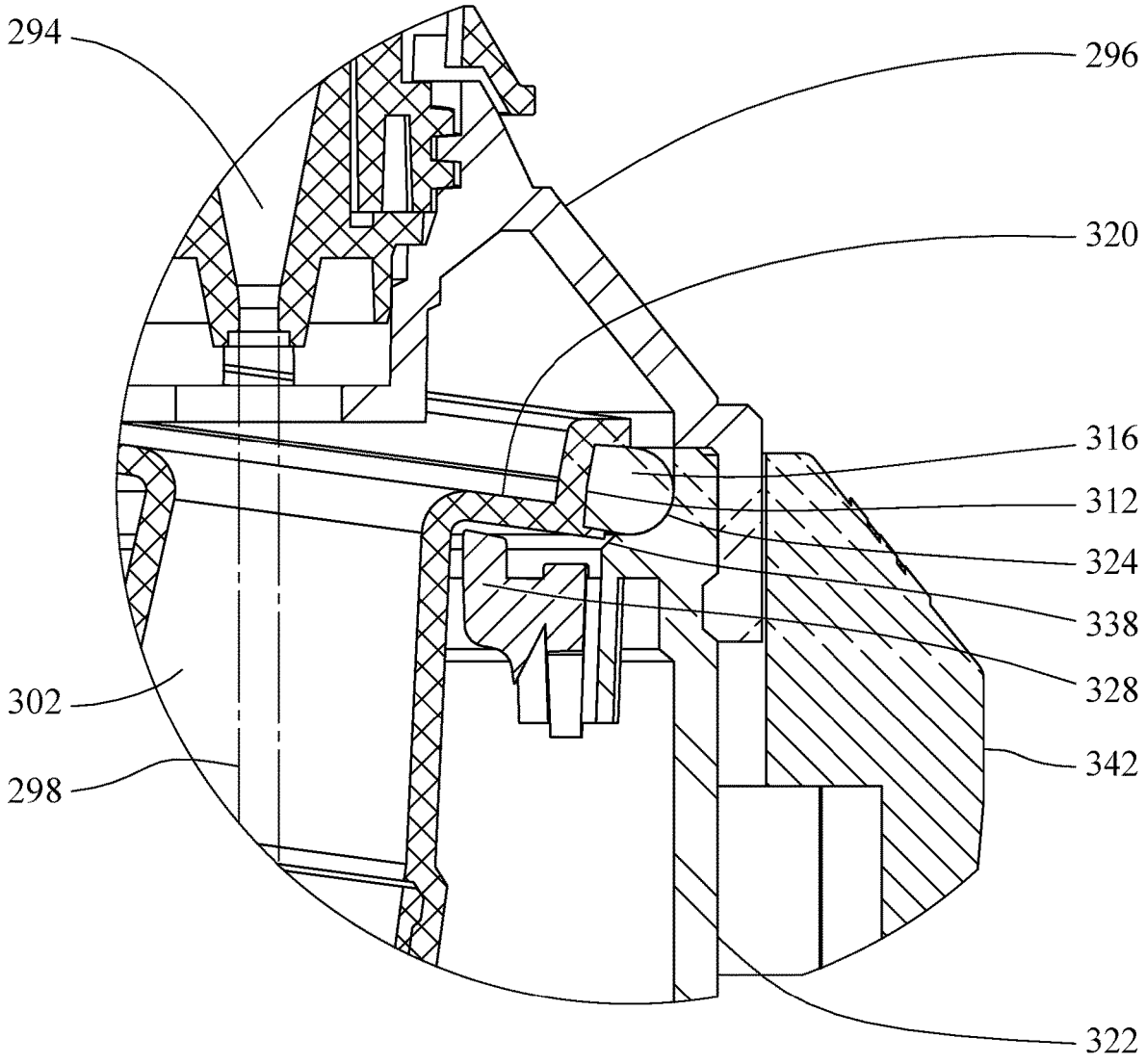
FIG. 20 is a detail cross sectional view of an alternate embodiment of a friction band having a non-circular profile of a spool of a sprinkler head in the running position.

FIG. 20 illustrates a cross sectional view of an alternate embodiment of a friction band in which the friction band has a non-circular profile. FIG. 20 depicts a portion of the spool 302, annular disc 320, upper annular profile 312, and upper friction band 316. FIG. 20 illustrates a nozzle 294 configured to spray fluid along fluid trajectory path 298 at a distribution plate (not illustrated in FIG. 20). The fluid path passes through the central bore of the spool 302. The spool has an annular disc 320 that is configured to rest on a raised projection 328 attached to an inner surface of the sprinkler body when the spool is at rest in an off position. The raised projection in the illustrated embodiment is removably connected to the sprinkler lower body 322.

The non-circular upper friction band 316 is formed with a rounded edge that is configured for rolling engagement with the upper race 324. The upper race has a starter ramp 338 upon which the upper friction band rests when the sprinkler head is in the off position. An sprinkler upper body 296 and sprinkler lower body 322 form the sprinkler body and house the spool 302 which forms a portion of the spool assembly (remainder not shown). The upper annular profile 312 is formed as a flat valley in the upper annular disc in the circumference of the upper annular disc. An optional sprinkler weight 342 is attached to the sprinkler head.

Figure 21:
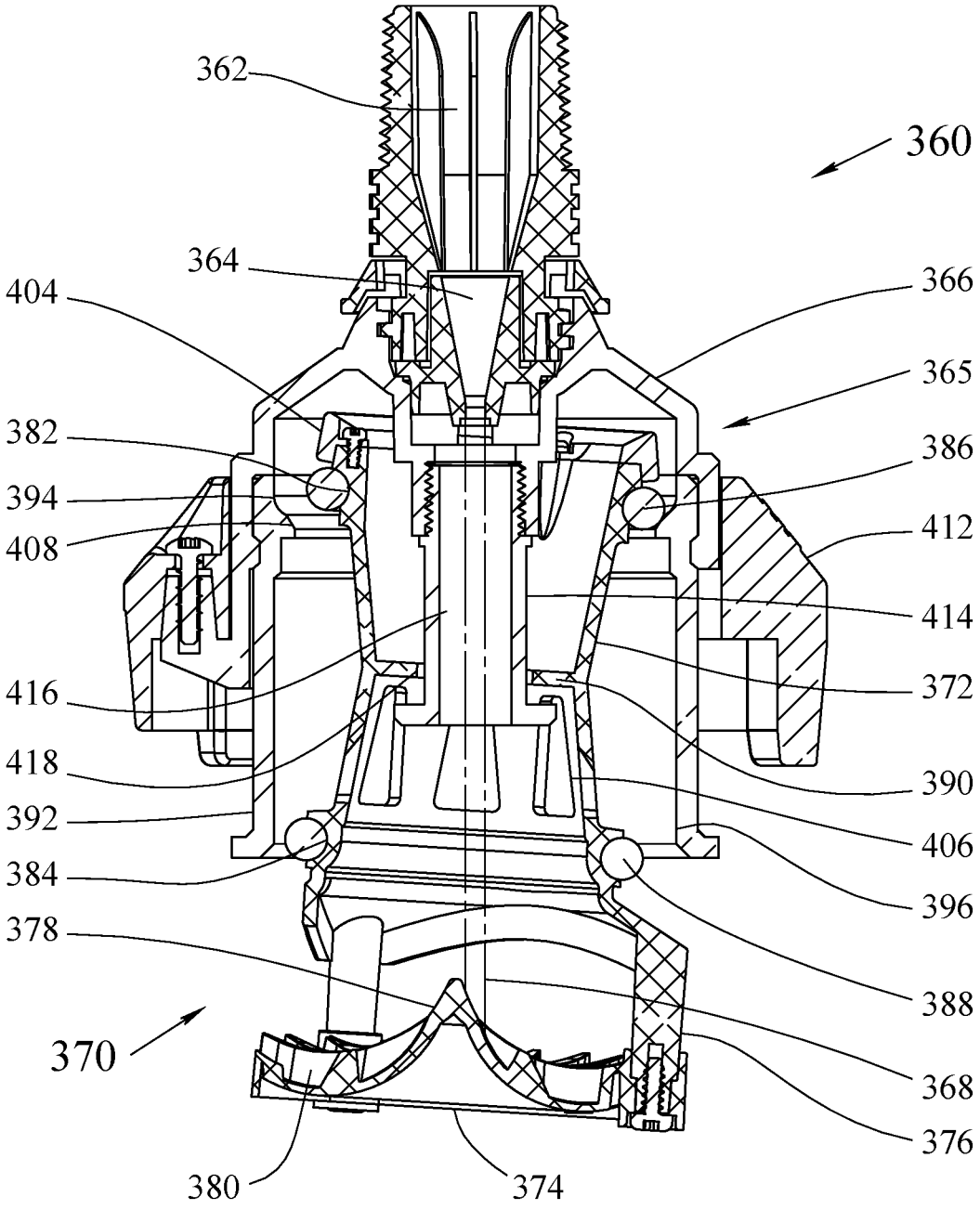
FIG. 21 is a cross sectional view of a fifth embodiment of a sprinkler head in the off position.
Figure 22:
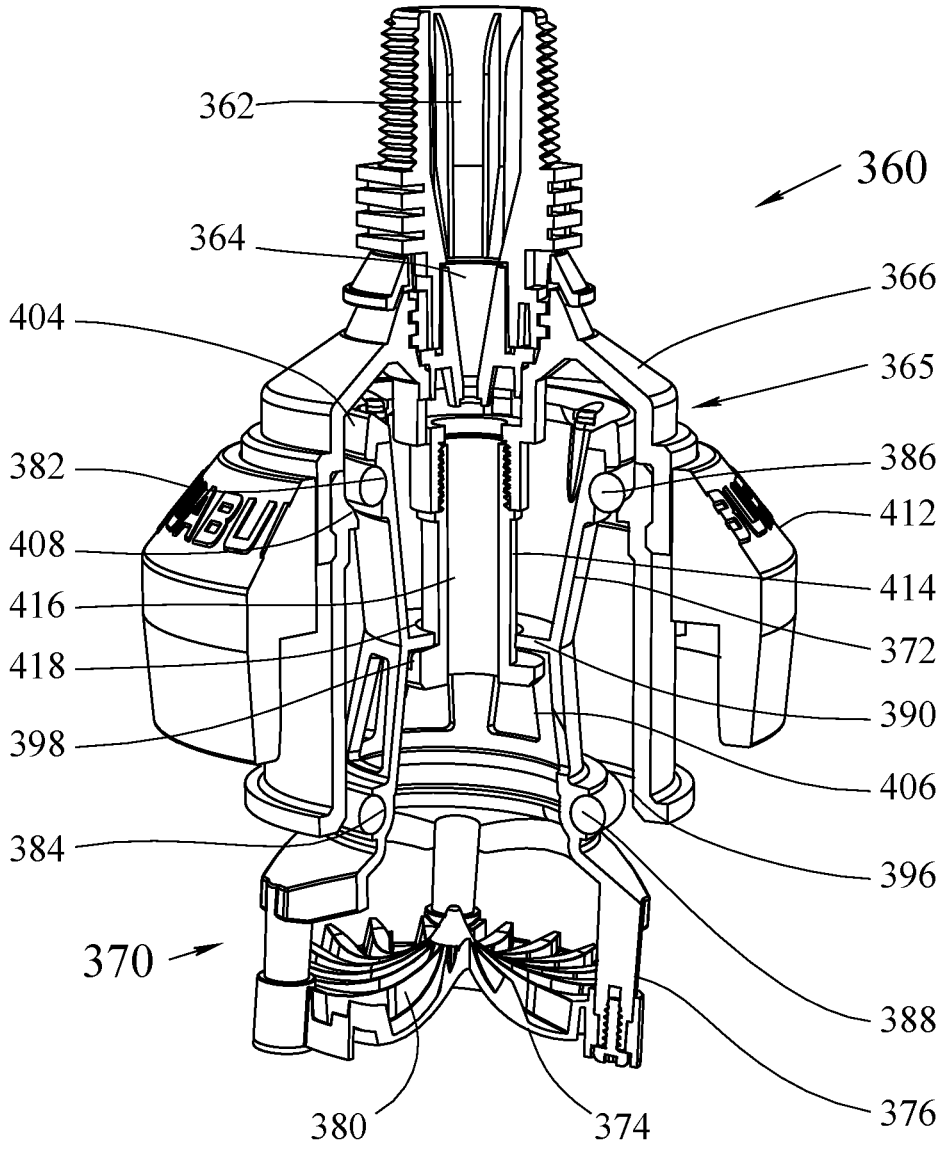
FIG. 22 is a partial cutaway perspective view of a fifth embodiment of a sprinkler head in the off position.
Figure 23:
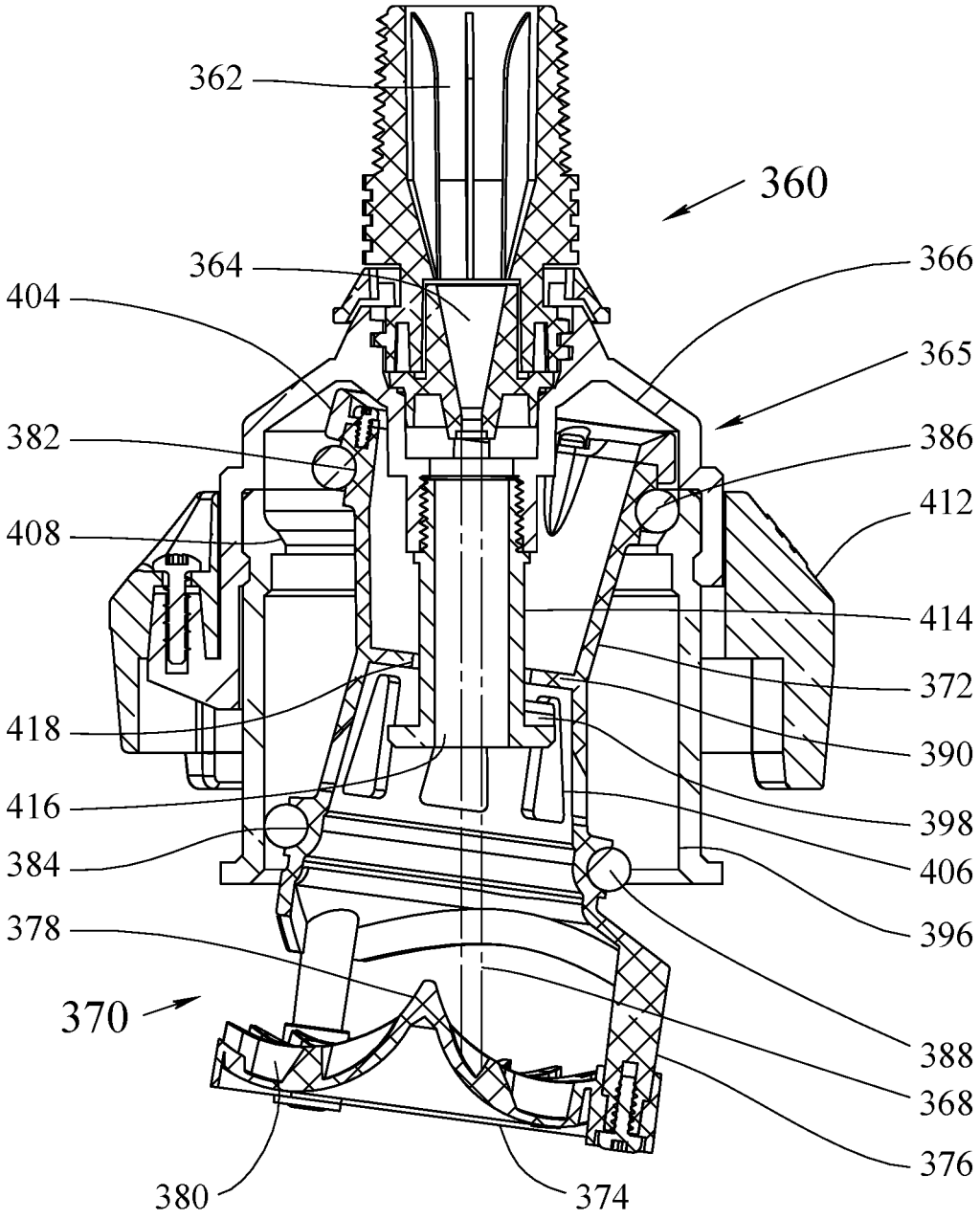
FIG. 23 is a cross sectional view of a fifth embodiment of a sprinkler head in the running position.

FIGS. 21-23 illustrate a fifth embodiment of a sprinkler head 360. FIG. 21 illustrates the fifth embodiment of a sprinkler head in the off position. The sprinkler body houses a spool assembly 370 that is configured to nutate within the sprinkler body. The sprinkler body 365 has a sprinkler upper body 366 and a sprinkler lower body 392. An optional sprinkler weight 412 is shown attached to the sprinkler body. A fluid delivery tube 362 is configured to provide fluid to the nozzle 364. The nozzle sprays the fluid in a directed stream along fluid trajectory path 368 at the fluid distribution plate 374. The fluid distribution plate 374 has a generally peaked surface 378 and a series of spirally radiating grooves 380 extending therefrom. The peak and spirally radiating grooves of the fluid distribution plate are configured to distribute fluid away from the sprinkler head.

The fluid distribution plate 374 is attached to the spool 372 by one or more arms 376. The spool has a generally cylindrical shape having the general shape of an hourglass, with a wider top and bottom and a narrower waist. The spool is depicted with optional cutouts 406 operating as a weight-reducing feature.

The depicted sprinkler head utilizes a spool support tube 414 to support the spool assembly when the spool assembly is at rest when the sprinkler is in the off position. The spool support tube in the depicted embodiment is threadingly attached to the sprinkler upper body 366. Fluid is sprayed through the spool support tube center bore 416 from the nozzle 364 and onto the fluid distribution plate 374. In the depicted embodiment, the spool 372 has an annular disc 390 that extends inward from the spool in a central bore of the spool. The annular disc is configured with an aperture 418 is slightly larger than the spool support tube to allow the spool to freely nutate around the spool support tube, but the aperture is small enough to prevent the spool from excessive misalignment when the spool assembly is at rest. The spool support tube has a raised projection 398 (shown in FIG. 22) on which the annular disc 390 of the spool rests in a tilted position when the sprinkler body is in an off position. In this position the spool assembly hangs in a tilted position when the sprinkler head is off. The spool is further shown with an optional counterbalance weight 404 attached to the top of the spool.

The inner surface of the sprinkler lower body has an upper race 394. A starting ramp 408 projects off of the upper race. FIG. 21 illustrates an upper friction band 386 resting against the starting ramp 408 when the sprinkler head is in an off position. The upper friction band 386 is attached to the spool in an upper annular profile 382 formed on an outer surface of the spool. When the sprinkler head starts the upper friction band begins rolling along the starter ramp 408 upward and into the upper race. The upper friction band then rolls radially within the upper race of the sprinkler head body when the sprinkler is in an on position and the spool assembly 370 is nutating within the sprinkler body 365.

A lower friction band 388 is attached to the spool at a lower annual profile 384. The lower friction band 388 is configured to radially roll against a lower surface of the sprinkler lower body. This radially rolling engagement occurs along the inner surface of the sprinkler lower body. This section of the inner surface of the sprinkler lower body is called a race 396. The race can have a defined structure or can provide minimal or no definition, as shown in FIG. 21.

FIG. 22 illustrates a partial cutaway perspective view of the fifth embodiment of a sprinkler head in the off position. FIG. 22 illustrates the annular disc 390 of the spool resting against the raised projection 398 of the spool support tube. The annular disc resting against the raised projection causes the spool assembly 370 to hang at an angle, as depicted in FIG. 22.

FIG. 23 illustrates the fifth embodiment of a sprinkler head in a running position. In the running position, fluid is being delivered through the fluid delivery tube 326 to the nozzle 364 and sprayed in a stream along fluid trajectory path 368 through the central bore 416 of the spool support tube 414. The fluid spray onto the distribution plate 374 causes nutation of the spool assembly within the sprinkler body housing 360. The upper friction band 386 is radially rolling in the upper race 394. The lower wearable friction disk is radially rolling along the inner surface, or race, of the sprinkler body.

Figure 24:
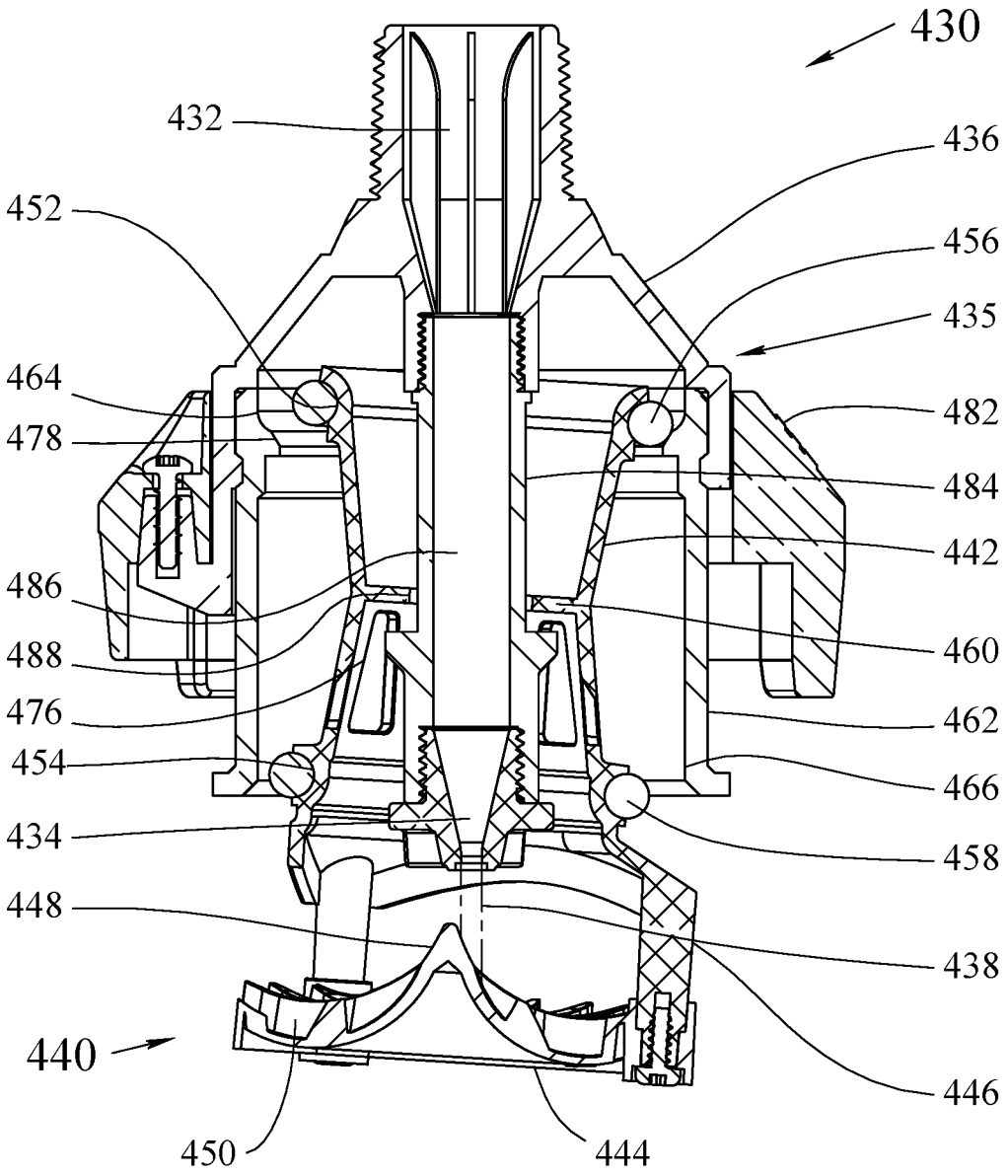
FIG. 24 is a cross sectional view of a sixth embodiment of a sprinkler head in the off position.
Figure 25:
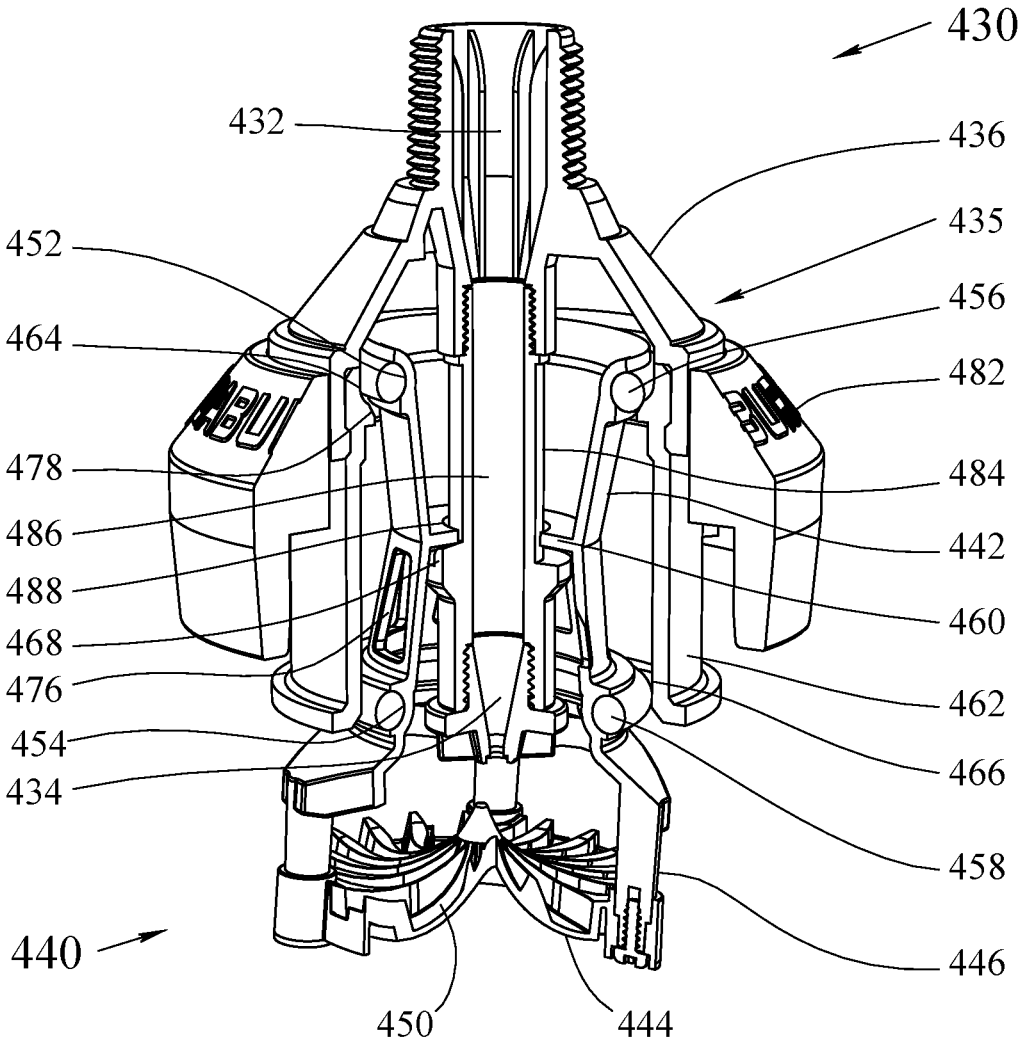
FIG. 25 is a partial cutaway perspective view of a sixth embodiment of a sprinkler head in the off position.
Figure 26:
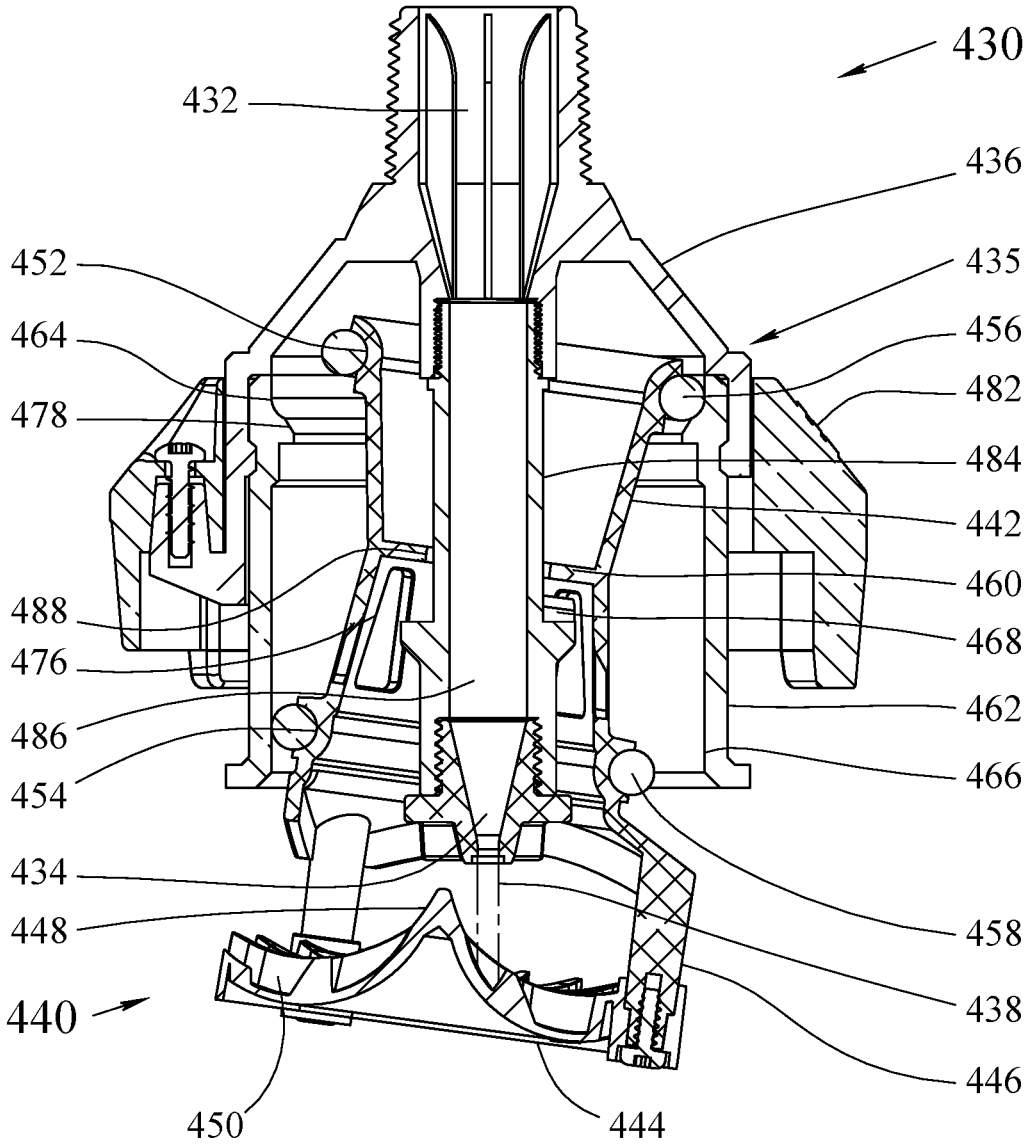
FIG. 26 is a cross sectional view of a sixth embodiment of a sprinkler head in the running position.

FIGS. 24-26 illustrate a sixth embodiment of a sprinkler head. FIGS. 24 and 25 illustrate the sixth embodiment of a sprinkler head 430 in the off position. FIG. 24 illustrates a sprinkler head having sprinkler body 435 housing a spool assembly 440. The spool assembly is configured to nutate within the sprinkler body when the sprinkler is in the on position. A fluid delivery tube 432 is configured to provide water through a central bore 486 of a spool support tube 484 and through a nozzle 434. The nozzle 434 is configured to spray a fluid stream along fluid trajectory path 438 on to fluid distribution plate 444. The nozzle is attached to an end of the spool support tube 484. The spool support tube 484 is threadingly attached to the spool upper body. Preferably the nozzle is threadingly attached to the end of the fluid supply tube. The fluid distribution plate has a generally peaked surface 448 and spirally radiating grooves 450 extending from the peak so as to distribute fluid sprayed on the distribution plate in a wetting pattern. The sprinkler body in the depicted embodiment is made up of a sprinkler upper body 436 and a sprinkler lower body 462. The sprinkler body has an optional sprinkler weight 482 attached thereto.

The spool assembly includes a spool 442 attached to the distribution plate 444 by one or more spool arms 446. The spool is illustrated with cutouts 476 that act as a weight reducing feature to locate the center of mass of the spool assembly closer to the center of rotation. An upper friction band 456 is attached to a spool 442. The upper friction band is attached to the spool at an upper annular profile 452 positioned on or in the spool surface. A lower friction band 458 is attached to the spool 442. The lower friction band is attached to the spool at a lower annular profile 454 formed on or in the spool surface. The spool has an inner annular disc 460 between the upper friction band and lower friction band that is configured to rest in the off position on a raised projection 468 of the spool support tube. This causes the spool assembly to hang at a tilted angle when the sprinkler is in the off position to facilitate initiation of nutation. The annular disc has an aperture 488 that is slightly larger than the spool support tube to allow the spool to freely nutate around the spool support tube, but the aperture is small enough to prevent the spool from excessive misalignment when the spool assembly is at rest.

The sprinkler lower body has an upper race 464 and a lower race 466. The upper friction band is configured to radially roll in the upper race when the spool assembly is nutating within the sprinkler body. The lower friction band is configured to radially roll in the upper race when the spool assembly is nutating within the sprinkler body. The upper race has a starting ramp 478 extending below the upper race. The upper friction band rests against the starting ramp when the sprinkler is in the off position. When the sprinkler initiates operation, the spool assembly begins rotation/nutation, and the upper friction band moves upward along the starting ramp until it is positioned to radially roll within the upper race.

FIG. 26 illustrates the sixth embodiment in a running position. The spool has moved upward with the upper friction band moving upward along the starting ramp to the race 464. The upper friction band is radially rolling on the upper race 464 while the lower friction band 458 is radially rolling along the lower race 466. The annular disc 460 has moved upward and away from the raised projection 468 allowing the spool assembly to nutate without contacting the raised projection.

While certain exemplary embodiments are shown in the Figures and described in this disclosure, it is to be distinctly understood that the presently disclosed inventive concept(s) is not limited thereto but may be variously embodied to practice within the scope of this disclosure. From the foregoing description, it will be apparent that various changes may be made without departing from the spirit and scope of the disclosure as defined herein.

The invention claimed is:

1. A fluid distributing sprinkler head, comprising, a fluid delivery tube in fluid connection with a nozzle;

a sprinkler body partially enclosing said fluid delivery tube and nozzle;

a spool assembly comprising, a spool having a generally cylindrical spool body and circumvolving said nozzle, wherein said spool comprising an annular disc;

a distribution plate fixedly connected to said spool in a spaced apart relationship by one or more spool arms, wherein said nozzle is configured to direct fluid via a fluid path through said spool body and onto said distribution plate, said distribution plate having a generally peaked surface, said surface incised by spirally radiating grooves, said spirally radiating grooves configured to cause said spool assembly to nutate within said sprinkler body when impinged upon by fluid directed by said nozzle;

an upper friction band and a lower friction band each circumvolving said spool, wherein said upper friction band comprises an upper friction band outer diameter and said lower friction band comprises a lower friction band outer diameter;

wherein said sprinkler body comprising an upper race and a lower race on an internal surface of said sprinkler body so as to radially limit nutation of said spool within said sprinkler body, wherein at least one of said upper race and said lower race comprises a starter ramp, wherein said starter ramp is configured such that one of said upper friction band or said lower friction band contacts a lower end of said starter ramp, wherein said sprinkler is configured such that upon start up of fluid spraying on said distribution plate generating centrifugal force on said spool and driving one of said upper friction band or said lower friction band up said starter ramp and into its respective race;

wherein said upper friction band and said lower friction band are spaced apart such that said upper friction band is configured to radially roll on said upper race on an inner diameter of said upper race when said spool assembly is nutating within said sprinkler housing and said lower friction band is configured to radially roll on said lower race when said spool assembly is nutating within said sprinkler housing; and at least one raised projection, wherein said spool assembly is configured to hang freely from said at least one raised projection by said annular disc when said spool assembly is without fluid and said sprinkler head is in a vertical position, wherein said driving of one of said upper friction band or said lower friction band up said starter ramp and into its respective race causes the lifting of said spool off of said at least one raised projection.

2. The sprinkler head of claim 1, wherein said upper friction band circumvolves said spool at an upper annular profile, wherein said lower friction band circumvolves said spool at a lower annular profile.

3. The sprinkler head of claim 2, wherein said spool assembly comprises a center of rotation between said upper annular profile and said lower annular profile, wherein said annular disc has an annular disc bottom face, wherein said bottom face is coincident with said center of rotation.

4. The sprinkler head of claim 2, wherein said annular disc is configured between a middle of said generally cylindrical body and said upper annular profile.

5. The sprinkler head of claim 2, wherein at least one of said upper friction band and said lower friction band has a circular cross-section.

6. The sprinkler head of claim 2, wherein at least one of said upper friction band and said lower friction band has a non-circular cross-section.

7. The sprinkler head of claim 2, wherein said upper annular profile is positioned at an edge of said annular disc.

8. The sprinkler head of claim 1, wherein said annular disc circumvolves said spool, wherein said sprinkler body comprises said at least one raised projection.

9. The sprinkler head of claim 8, wherein said at least one raised projection is removably connected to said sprinkler lower body.

10. The sprinkler head of claim 1, wherein said sprinkler body comprises a sprinkler upper body connected to a sprinkler lower body, wherein said upper race and said lower race are configured on an inner surface of said sprinkler lower body.

11. The sprinkler head of claim 1, wherein said lower sprinkler body is removably connected to said sprinkler upper body.

12. The sprinkler head of claim 1, wherein said upper friction band and said lower friction band each are removably attached to said spool.

13. The sprinkler head of claim 1, wherein at least one of said upper friction band and said lower friction band comprises friction band gear teeth, wherein at least one of said upper race and said lower race comprises race gear teeth, wherein said race gear teeth and said friction band gear teeth are configured to be opposing, wherein said gear teeth are configured to prevent slipping as said spool assembly nutates.

14. The sprinkler head of claim 1, wherein said upper friction band outer diameter and said lower friction band outer diameter are equal.

15. The sprinkler head of claim 1, wherein said spool assembly comprises a counterbalance weight.

16. The sprinkler head of claim 1, wherein said spool comprises an hourglass shape.

17. The sprinkler head of claim 1, wherein at least one of said upper race and said lower race comprises a starter ramp configured to cause said spool assembly to lift away from said at least one raised projection as said spool assembly begins to nutate.

18. The sprinkler head of claim 1, wherein at least one of said upper race and said lower race contain an upper limiting face configured to prevent said spool assembly from lifting out of said race.

19. The sprinkler head of claim 1, wherein a spool support tube is connected to said sprinkler upper body downstream of said fluid delivery tube, wherein said spool support tube comprises a center bore to allow for the passage of fluid through said bore, wherein said spool support tube comprises said at least one raised projection, wherein said spool circumvolves said spool support tube, wherein said annular disc is configured within said spool and circumvolves said spool support tube, wherein said spool is configured to hang freely from said at least one raised projection by said annular disc when said spool assembly is without fluid and said sprinkler head is in a vertical position.

20. The sprinkler head of claim 1, wherein a lower portion of said spool comprises a bell shape.

* * * * *